US011369824B2

(12) United States Patent
Carter et al.

(10) Patent No.: US 11,369,824 B2
(45) Date of Patent: Jun. 28, 2022

(54) EXERCISE DEVICES FOR ASSISTING A PERSON TO PERFORM BODYWEIGHT EXERCISES

(71) Applicants: Thomas Christopher Carter, Hawthorne, NY (US); William Bottiglieri, West Harrison, NY (US)

(72) Inventors: Thomas Christopher Carter, Hawthorne, NY (US); William Bottiglieri, West Harrison, NY (US); Ryan Arthur Kelly, Port Chester, NY (US); Bennet Otto Poepping, Tuckahoe, NY (US)

(73) Assignees: Thomas Christopher Carter, Hawthorne, NY (US); William Bottiglieri, West Harrison, NY (US)

( * ) Notice: Subject to any disclaimer, the term of this patent is extended or adjusted under 35 U.S.C. 154(b) by 0 days.

(21) Appl. No.: 16/892,633

(22) Filed: Jun. 4, 2020

(65) Prior Publication Data

US 2020/0384306 A1 Dec. 10, 2020

Related U.S. Application Data

(60) Provisional application No. 62/901,401, filed on Sep. 17, 2019, provisional application No. 62/858,567, filed on Jun. 7, 2019.

(51) Int. Cl.
*A63B 21/062* (2006.01)
*A63B 21/072* (2006.01)
(Continued)

(52) U.S. Cl.
CPC ..... *A63B 21/062* (2013.01); *A63B 21/0726* (2013.01); *A63B 21/154* (2013.01);
(Continued)

(58) Field of Classification Search
CPC ..... A63B 21/00047; A63B 21/151; A63B 21/154; A63B 21/155; A63B 21/156;
(Continued)

(56) References Cited

U.S. PATENT DOCUMENTS 4,243,219 A * 1/1981 Price ..... A63B 21/1681 482/904
4,529,191 A * 7/1985 Miller ..... A63B 1/00 482/40

(Continued)

FOREIGN PATENT DOCUMENTS

FR 2745191 A1 * 8/1997 ..... A63B 21/1654
GB 2085307 A * 4/1982 ..... A63B 21/1663

OTHER PUBLICATIONS

AmazeFan, "AmazeFan Pull Up Bar Doorway with Ergonomic Grip—Fitness Chin-Up Frame for Home Gym Exercise—2 Professional Quality Wrist Straps + Workout Guide—No Installation Needed(Fits Almost All Doors)", Nov. 9, 2018.

(Continued)

*Primary Examiner* — Nyca T Nguyen
*Assistant Examiner* — Zachary T Moore
(74) *Attorney, Agent, or Firm* — Leason Ellis LLP

(57) ABSTRACT

An exercise device for assisting a user in performing bodyweight exercises as well as being configured for performance of weight training cable exercises includes a frame that is configured to be detachably mounted to a doorframe. The frame includes a first door bar and a second door bar that is spaced from the first door bar and is configured for contacting the doorframe on a first side of the doorframe. The exercise device also includes a pair of door hook assemblies that are coupled to the frame and are configured to seat against a ledge of the doorframe on a second side of the doorframe for securely yet detachably mounting the frame to the doorframe. A pulley carrier assembly is detach- (Continued)

ably coupled to both the first door bar and the second door bar and includes an elongated carrier that carries a first pulley and a spaced second pulley. A cable passes along the first pulley and the second pulley and the cable has a first end and an opposing second end. The device also includes a counter-weight coupled to a first end of the cable.

27 Claims, 19 Drawing Sheets

(51) Int. Cl.
*A63B 21/16* (2006.01)
*A63B 21/00* (2006.01)

(52) U.S. Cl.
CPC ..... *A63B 21/1627* (2013.01); *A63B 21/1636* (2013.01); *A63B 21/4015* (2015.10)

(58) Field of Classification Search
CPC ... A63B 21/062; A63B 21/0626; A63B 21/08; A63B 21/1618; A63B 21/1627; A63B 21/1636; A63B 21/1645; A63B 21/1663; A63B 23/1209; A63B 23/1218; A63B 23/1245; A63B 23/1281
See application file for complete search history.

(56) References Cited

U.S. PATENT DOCUMENTS 5,072,934 A * 12/1991 Blanes ..... A63B 21/1627 482/904
5,601,518 A * 2/1997 Weintraub ..... A63B 21/0552 482/904
6,508,743 B1 * 1/2003 Fortin ..... A63B 1/00 482/40
9,044,641 B2 * 6/2015 Velikin ..... A63B 1/005
10,898,752 B1 * 1/2021 Kehoe ..... A63B 23/03525
2005/0250619 A1 * 11/2005 Daikeler ..... A63B 1/00 482/40
2007/0161469 A1 * 7/2007 Lamle ..... A63B 23/1209 482/99
2012/0115684 A1 * 5/2012 Nguyen ..... A63B 21/1627 482/40
2013/0040784 A1 * 2/2013 Gillespie ..... A63B 23/1218 482/39
2013/0178338 A1 * 7/2013 Ross ..... A63B 23/1218 482/40
2013/0196824 A1 * 8/2013 Ross ..... A63B 21/1645 482/40
2013/0225373 A1 * 8/2013 Poat ..... A63B 23/1227 482/40
2013/0288861 A1 * 10/2013 Cole ..... A63B 21/4043 482/102
2014/0094347 A1 * 4/2014 Orakwusi ..... A63B 23/1218 482/38
2014/0106949 A1 * 4/2014 Mestemaker ..... A63B 21/1636 482/129
2016/0166874 A1 * 6/2016 Sheeler ..... A63B 1/00 482/40
2018/0085622 A1 * 3/2018 Ivan ..... A63B 23/1218

OTHER PUBLICATIONS

AMZEmart, "4 In 1 Doorway Trainer Pullup Bar", Shopify, Copyright 2021, On or before Oct. 1, 2019.
IDEER Life, "IDEER Life Pull Up Doorway Fitness Chin Up Stregth Training Bars, 4 in 1 Pull Up Bar, Dip Bar & Power Ropes, Foldable Door Bar Ergonomic Grip TRainier Workout for Home Gym Exercise", On or before Oct. 1, 2019.

* cited by examiner

EXERCISE DEVICES FOR ASSISTING A PERSON TO PERFORM BODYWEIGHT EXERCISES

CROSS-REFERENCE TO RELATED PATENT APPLICATIONS

This application is based on and claims priority to U.S. Provisional Patent Application No. 62/858,567, filed Jun. 7, 2019 and U.S. Provisional Patent Application No. 62/901,401, filed Sep. 17, 2019, all of which are incorporated by reference, as if expressly set forth in their respective entireties herein.

TECHNICAL FIELD

The present invention is directed to exercising equipment and more particularly, to devices that are configured for assisting and training a person to perform bodyweight exercises, such as pull-ups, push-ups, and dips, as well as allowing the user to perform other weight lifting exercises.

BACKGROUND

As is well known, exercising is an integral part of a healthy lifestyle. Exercise can help keep your body at a healthy weight. Exercise helps people lose weight and lower the risk of some diseases. Exercising regularly decreases a person's risk of developing certain diseases, including obesity, type 2 diabetes, and high blood pressure. Exercise can also help a person age well. It is well accepted that regular exercise provide the following benefits to your body and brain: (1) it can make you feel happier; (2) it can help with weight loss; (3) it is good for your muscles and bones; (4) it can increase your energy levels; (5) it can reduce your risk of chronic disease; (6) it can help skin health; and (7) it can help you brain health and memory.

There are a wide variety of different types of exercising from organized team sports to individual training. Exercising can target one or more body parts for conditioning and/or strengthening. For example, one type of exercise is a pull-up which is an upper-body strength exercise. The pull-up is a closed-chain movement where the body is suspended by the hands and pulls up. As this happens, the elbows flex and the shoulders adduct and extend to bring the elbows to the torso.

For most people, pull-ups are very difficult to perform. One of the main reasons pull-ups are so challenging is that they force you to lift your entire bodyweight using nothing but your upper body. It's not just weight and poor muscle strength that make pull-ups hard; mechanics and physics play a significant role as well.

Traditionally, the means for developing the strength of a person to perform pull-ups when that person did not have the necessary strength, was to put the person on a weight-lifting schedule. As the strength of the person is increased, due to lifting weights, then pull-ups may again be attempted. This continued until the person could perform at least one pull-up. The person then further develops by continuing to do pull-ups.

Other popular exercises are push-ups and dips. By raising and lowering the body using the arms, push-ups exercise the pectoral muscles, triceps, and anterior deltoids, with ancillary benefits to the rest of the deltoids, serratus anterior, coracobrachialis and the midsection as a whole. Dips are a bodyweight exercise that develops the triceps and other upper-body muscles. The exercise begins when you hold on to parallel bars with your arms straight. You then bend your elbows until your upper arms are parallel to the ground before driving up to the starting position.

While this traditional technique is helpful, there is a need for developing other ways to train a user to perform a bodyweight exercise. The present invention addresses this need and provided devices that are configured to assist and train a person to perform body exercises.

Weight lifting exercises are also popular in which the user lifts weights, which can be in the form of a dumbbell or barbell in order to exercise a particular body part.

SUMMARY

The present invention is directed to devices that are configured to assist a user in performing bodyweight exercises and in particular, the device is configured to be used in different ways to perform different bodyweight exercises, including push-ups, pull-ups and dips. The device is configured to mount within a doorway and is designed to both assist a user in performing a bodyweight exercise (e.g., pull-ups, push-ups, dips) and also is configured to allow the user to perform any number of types of weight lifting exercises for training and conditioning of one or more body parts, such as the biceps, triceps, etc.

In one embodiment, an exercise device for assisting a user in performing bodyweight exercises as well as being configured for performance of weight training cable exercises includes a frame that is configured to be detachably mounted to a doorframe. The frame includes a first door bar and a second door bar that is spaced from the first door bar and is configured for contacting the doorframe on a first side of the doorframe. The exercise device also includes a pair of door hook assemblies that are coupled to the frame and are configured to seat against a ledge of the doorframe on a second side of the doorframe for securely yet detachably mounting the frame to the doorframe. The exercise device also includes a pulley carrier assembly that is detachably coupled to both the first door bar and the second door bar and includes an elongated carrier that carries a first pulley and a spaced second pulley. The second pulley is positioned on the second side of the doorway. A cable passes along the first pulley and the second pulley and the cable has a first end and an opposing second end. The device also includes a counterweight coupled to a first end of the cable.

In another embodiment, an exercise device for mounting to a doorframe includes a frame that is configured to be detachably mounted to the doorframe. The frame includes a first door bar and a second door bar that is spaced from the first door bar and is configured for contacting the doorframe on a first side of a doorframe. The exercise device also includes a pair of door hook assemblies that are coupled to the frame and move between a collapsed position and an extended position. Each door hook assembly has a first portion that is configured to seat against a ledge of the doorframe on a second side of the doorframe for securely yet detachably mounting the frame to the doorframe. The door hook assembly is adjustable in a first direction and in a second direction that is perpendicular to the first direction.

In another embodiment, an exercise device for mounting to a doorframe is provided and includes a frame that is configured to be detachably mounted to the doorframe. The frame includes a first door bar and a second door bar that is spaced from the first door bar and is configured for contacting the doorframe on a first side of a doorframe. The exercise device also includes a pair of door hook assemblies that are coupled to the frame and move between a collapsed position and an extended position. Each door hook assembly has a first portion that is configured to seat against a ledge of the doorframe on a second side of the doorframe for securely yet detachably mounting the frame to the doorframe. The door hook assembly is adjustable in a first direction and in a second direction that is perpendicular to the first direction.

This adjustability of the door hook assemblies thus provides the exercise device with increased versatility and permits it to be used with many different sized doorways. The exercise device can thus be marketed as a single product with instructions to the user on how to make the necessary adjustments depending upon the precise doorway construction.

Other details are disclosed herein.

BRIEF DESCRIPTION OF THE DRAWING FIGURES

DETAILED DESCRIPTION OF CERTAIN EMBODIMENTS

As mentioned, the present invention is broadly directed to a device or system or kit that can be detachably mounted to a doorway and is configured to both: (1) assist a user in performing body weight exercises, such as pull-ups, push-ups, dips, and (2) allow the user to perform a wide variety of weight lifting exercises for exercising one or more body parts.

At least in one aspect, the present invention provides a device for a person to build up strength to perform pull-ups by starting right out in a pull-up environment by effectively reducing his weight by counter-balance means (counter weight) so that once a sufficient amount of his weight is offset, the person can start right out performing pull-ups. As the person's skills and strength are developed, the weight of the counter-weight is reduced until the person can successfully lift his own weight. It has been found that a person begins to develop the ability to perform pullups against his own weight sooner by this method than by the prior art weight-lifting method.

The device thus assists a person to perform pull-ups by cancelling a portion of a person's bodyweight and then gradually decreasing the reduced bodyweight until the person can lift his own weight successfully without aid of the device. Advantageously, the present pull-up employs a pullup environment from the beginning of the training.

Similarly, the device also is configured to assist the user in performing other bodyweight exercises, including but not limited to push-ups and dips as discussed herein.

It will therefore be appreciated that while the below discussion extensively discusses the device (system or kit) as one which serves as a pull-up assist device, such implementation is only one embodiment, and the device more broadly is a device that is mountable within a standard doorway without using hardware or fasteners and allows a wide variety of exercises to be performed.

Figure 1:
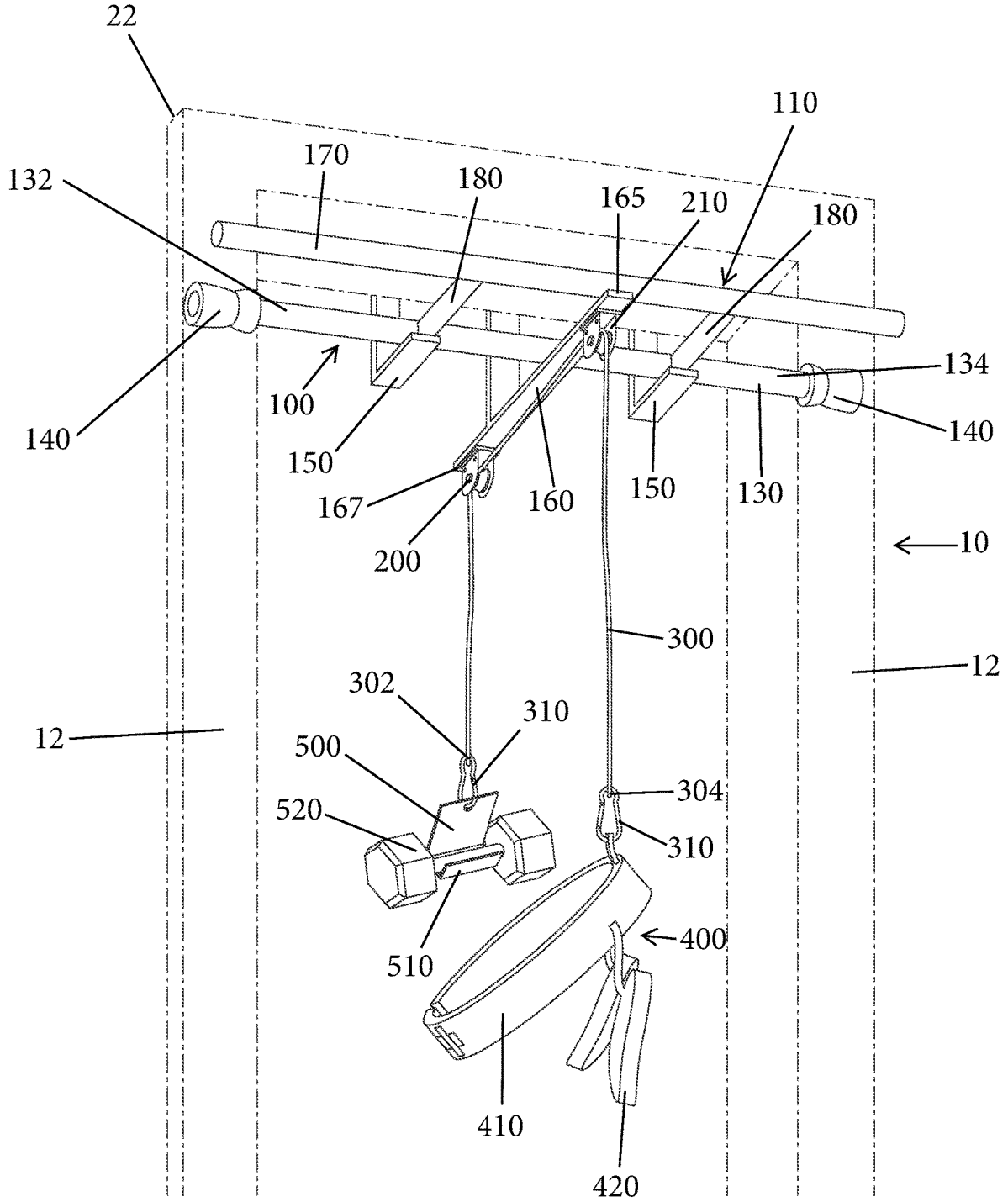
FIG. 1 is a perspective view of an exercise device, in accordance with a first embodiment, for assisting a person in performing a bodyweight exercise (e.g., pull-up, push-ups, dips), as well as weight lifting exercises, with the device being shown removably mounted to a door frame and illustrating a counterweight of a first type.
Figure 2:
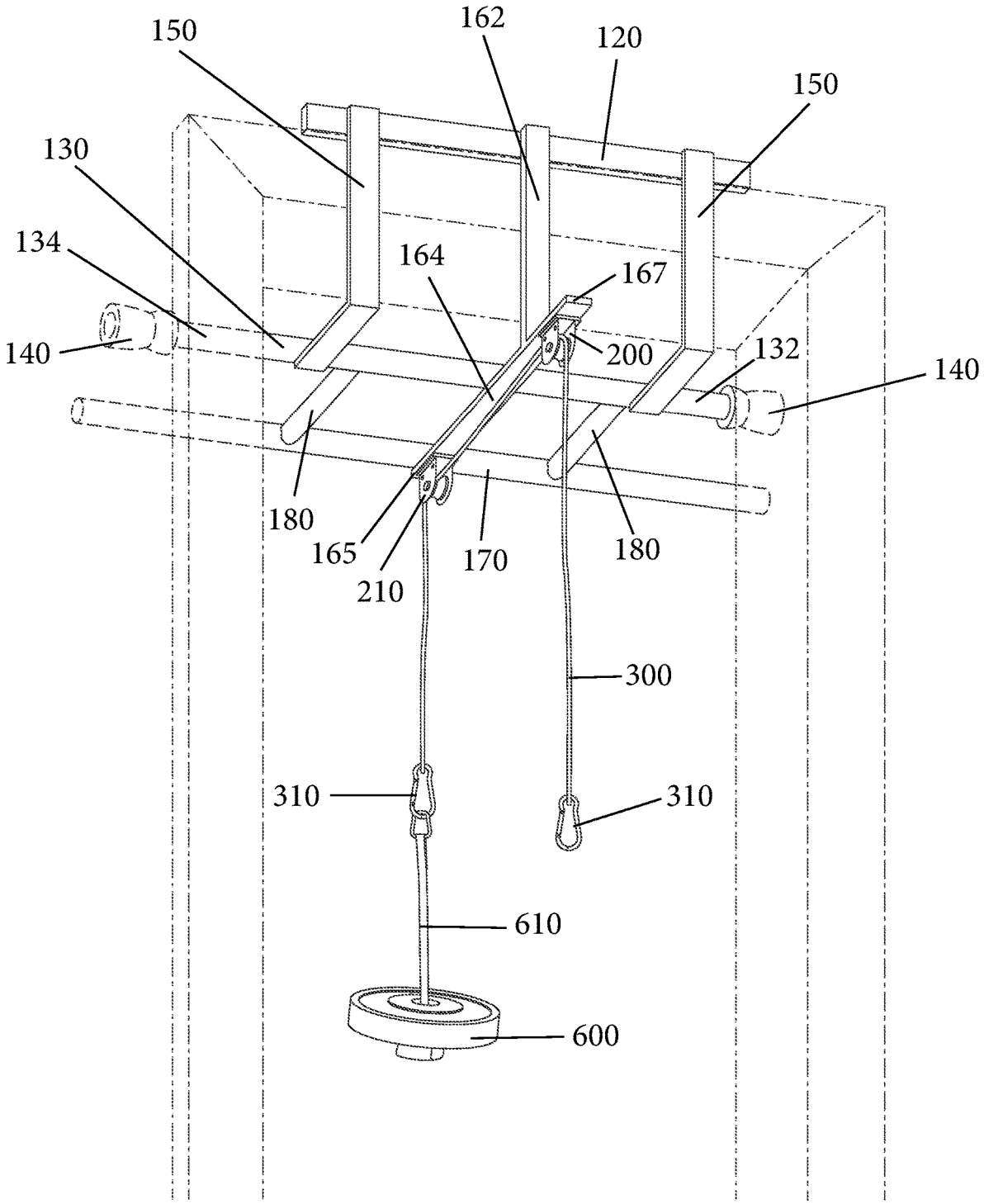
FIG. 2 is another perspective view of the device mounted to the door frame and illustrating a counterweight of a second type.
Figure 3:
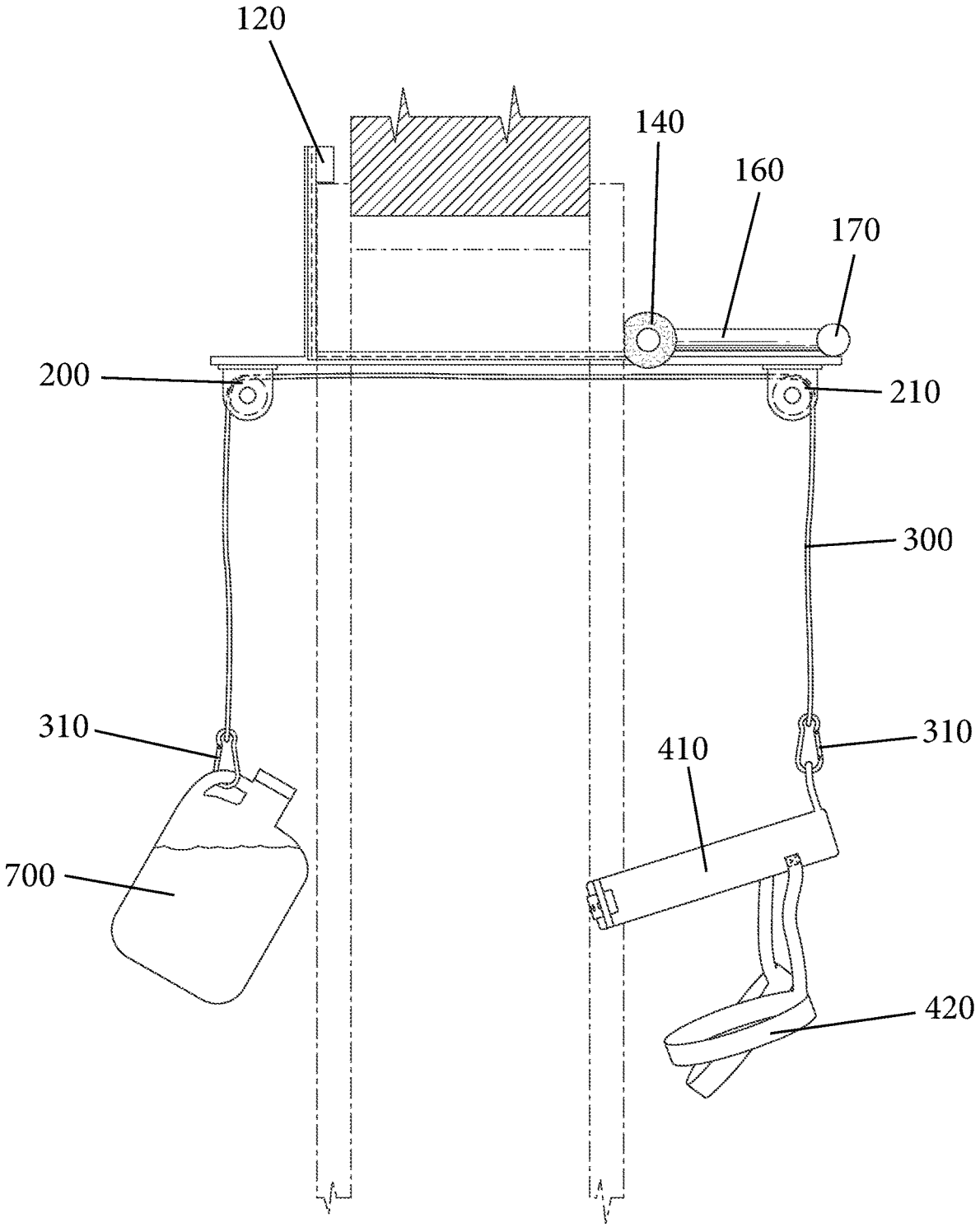
FIG. 3 is a cross-sectional view of the device mounted to the door frame.
Figure 4:
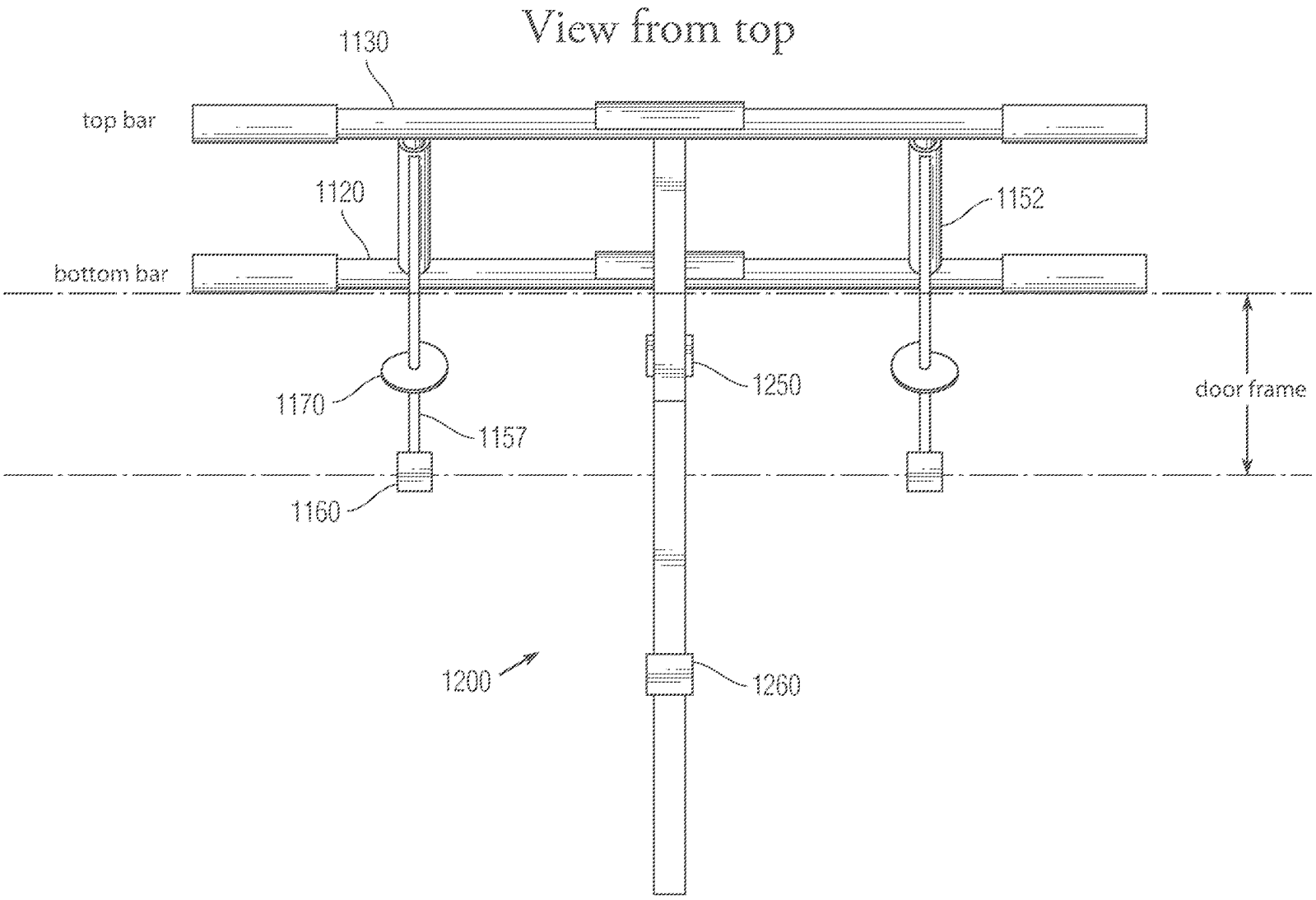
FIG. 4 is a top plan view of another exercise device in accordance with a second embodiment.
Figure 5:
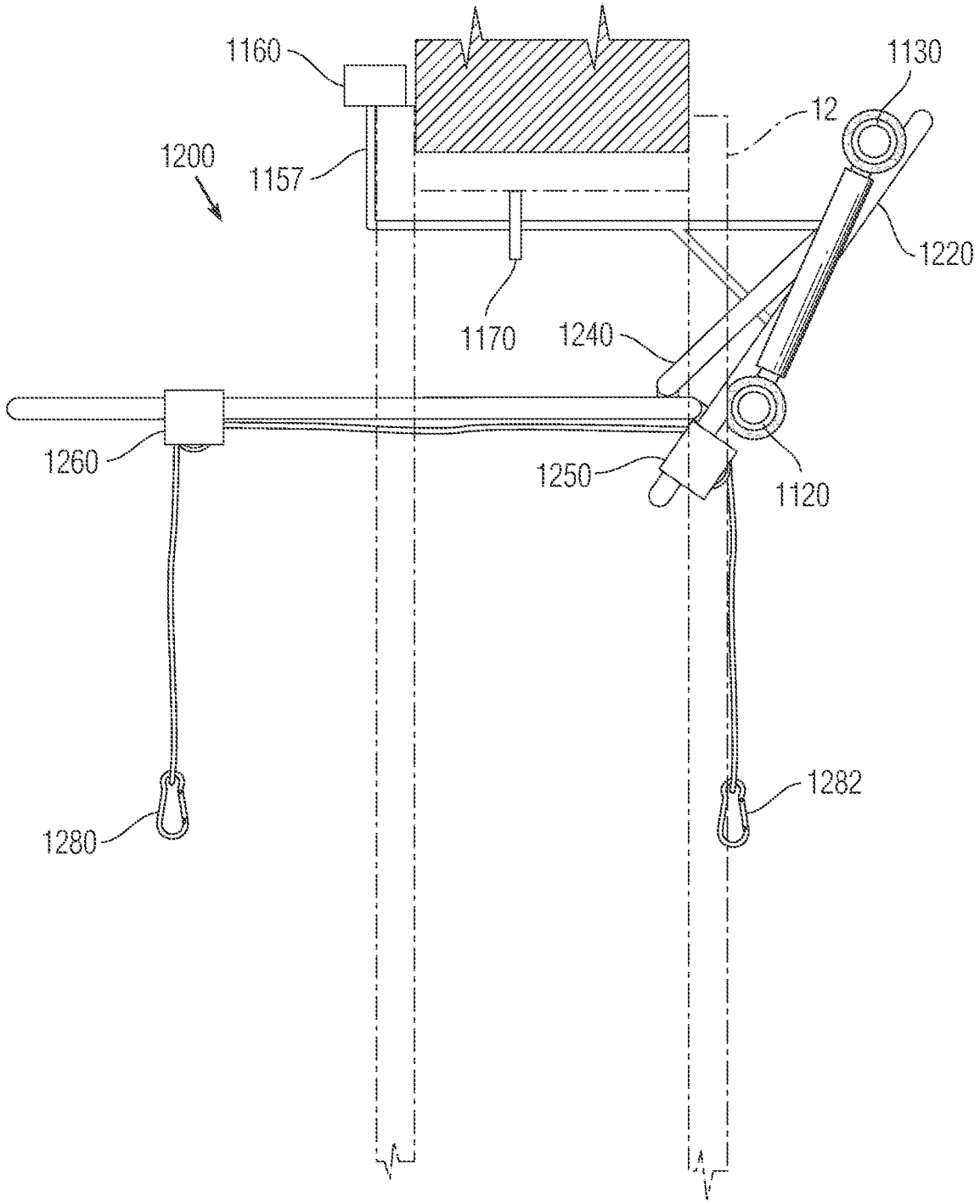
FIG. 5 is a side elevation view thereof.

FIGS. 1-3 illustrate a device 100, in accordance with a first embodiment of the present invention, that is configured to assist the user in performing bodyweight exercises. As shown, the pull-up device 100 is configured to be removably mounted to a traditional doorway (door frame) 10 without any tools required. As is known, a traditional doorway 10 includes a door frame or casing that includes side trim 12 and a head (head jamb) or top casing 20 that extends horizontally above the door and between the side trim 12. The top casing 20 protrudes outwardly from the wall and thus, there is a ledge 22 that is defined as a top edge of the top casing 20. The doorway 10 has a first face or side that is typically located in one room and a second face or side that is typically located in another room.

The pull-up device 100 includes a frame 110 that can be carried by the user and is then installed/mounted in the manner described herein. The frame 110 includes a first cross mount 120 that is intended to sit along the ledge 22 of the top casing 20 along the first face of the doorway 10 in a first room or space and can be in the form of a first horizontal bar. The first cross mount 120 can have a rectangular shape since the ledge 22 is a planar surface.

The frame 110 also includes a second cross mount 130 that is for positioning on the second face of the doorway 10 in a second room. The second cross mount 130 can be in the form of a tubular structure that has a first end 132 and an opposing second end 134. As shown in the figures, the second cross mount 130 seats against the opposing side trim 12 of the door frame 10 and more specifically, there can be two points of contact between the second cross mount 130 and the side trim 12. The two points of contacts are located along the opposing side trim 12 of the door frame 10 at or proximate the ends 132, 134. As shown, the first end 132 and the second end 134 can have protective members 140 for the points-of-contact with the door frame 10 to avoid marking or damage. The protective members 140 can be in the form of padding or rubber caps or the like.

The frame 110 further includes first connectors that connect the first cross mount 120 to the second cross mount 130 and more particularly, the connectors can be in the form of a pair of end connectors 150 and a middle connector 160 that is located between the pair of end connectors 150. Each of the pair of end connectors 150 can have an L-shape with one leg being connected to the first cross mount 120 and the second leg being connected to the second cross mount 130. Any number of different techniques can be used to connect the connectors 150, 160 to the first cross mount 120 and the second cross mount 130. For example, a weld or bond can be formed between these parts. The connectors 150, 160 can be evenly spaced apart.

The frame 110 also includes a cross member 170 that is for positioning in the second room along with the second cross mount 130 and is positioned further away from the door frame 110 than the second cross mount 130. The cross member 170 is coupled to the second cross mount 130 and more specifically, the cross member 170 can be attached to the second cross mount 130 with a plurality of second connectors 180. The second connectors 180 are attached at first ends to the second cross mount 130 and at second ends to the cross member 170. The second connectors 180 can be in the form of tubular structures that are attached. e.g., welded, to the second cross mount 130 and the cross member 170. The second connectors 180 can be axially aligned with the connectors 150, 160: however, in other embodiments, the second connectors 180 can be spaced from and not axially aligned with the connectors 150, 160.

In the illustrated embodiment, there are two second connectors 180.

As shown in the figures, the middle connector 160 can have a different construction than the end connectors 150. For example, the middle connector 160 can have a T shape with a first leg 162 that attaches to the first cross mount 120 and intersects a second leg 164. The second leg 164 has a first end 165 and an opposing second end 167 that is closer to the point of intersection between the legs 162, 164. The section of the second leg 164 between the second end 167 and the point of intersection between the legs 162, 164 can be thought of as being an extension.

The cross member 170 can be in the form of a tubular structure and similarly, the second connectors 180 can be in the form of tubular structures. It will be understood that the cross member 170 can be eliminated and the pull-up bar (to be grasped by the user) instead is the second cross mount 130 (in this case, the connectors 150, 160 terminate at the second cross mount 130).

The device 100 also includes a first pulley 200 and a second pulley 210 with the first pulley 200 being secured to an underside of the middle connector 160 at or near the second end 167 and the second pulley 210 being secured to an underside of the middle connector 160 at or near the first end 165. The extension of the second leg 164 serves to space the pulleys 200, 210 a sufficient distance from one another. The middle connector 160 has a length such that it extends to the cross member 170 and beyond the end connectors 150 and this construction allows the first pulley 200 to be located in the first room (on the first side of the doorway) and the second pulley 210 is located in the second room (on the second side of the doorway).

A cable 300 is routed along the first pulley 200 and the second pulley 210. The cable 300 has a first end 302 that can be located in the first room and an opposing second end 304 that can be located in the second room. The first and second ends 302, 304 can be looped ends.

At the ends 302, 304, there are cable connectors 310 that are securely attached to the ends (looped) end 302, 304 of the cable 300. The cable connectors 310 can take any number of different forms including being carabiners as shown in the figures: however, other types of connectors can equally be used. For example, clips or clamps can be used or alternatively, the cable connectors 310 can be in the form of books.

The device 100 also includes a means for releasably attaching a user's body to one end of the cable 300 and in particular, for attachment to the second end 304 of the cable 3).

This means can be in the form of a belt or harness 400 to be worn by the user. The harness 400 can be of any number of different suitable types such as a rock climbing harness, etc., and the harness 400 includes a belt portion 410 that is secured around the waist of the user and leg straps (belts) 420 to be secured around the legs of the user. The harness 400 is configured for attachment to the cable connector 310 at the second end 304 of the cable 3). For example, the harness can include a loop of clamp (e.g., D clamp) that mates with the cable connector 310 to allow easy attachment and removal (detachment) of the harness from the cable 300. The harness 400 thus provides a means for attaching the user to the cable 300.

At the opposite first end 302 of the cable 300 there is a counter-weight that is configured to be detachably coupled to the cable connector 310 at the first end 302 of the cable 3). The counter-weight thus acts as a counter-balance means that effectively reduces the weight of the user in the pull-up environment so that once a sufficient amount of his weight is offset, the person could start right out performing pull-ups. As described herein, the counter-weight is initially positioned above the ground and thus by gravity, the counter-weight falls to the ground as the user begins the pull-up action and acts as a counter-balance that effectively reduces the weight of the user that is raised off the ground to complete the pull-up.

FIGS. 1-3 show different types of counter-weights with each being described below and Appendix A also shows different exemplary counter-weights.

FIG. 1 shows a first counter-weight that includes an L-shaped bracket 500 with a first leg that is detachably coupled to the cable connector 310. The second leg of the first counter-weight terminates in an upturned lip 510. The second leg is formed perpendicular to the first leg and thus can represent, in combination with the upturned lip 510, a tray on which a free weight 520 can rest. For example, the free weight 520 can be in the form of a dumbbell that has a center handle section that is disposed along the second leg and the upturned lip 510 which holds the free weight 520 in place. In the event that the bracket 500 is not perfectly horizontal, the enlarged ends of the free weight 520 prevent the free weight 520 from sliding laterally out of the bracket 500.

FIG. 2 shows a second counter-weight that is in the form of a barbell weight 600 that includes a center hole through which a cable or rope or the like 610 pass through the center hole. One end of the rope 610 is secured to the cable connector 310, while the other end of the rope 610 is coupled and secured to the barbell weight 600. During a lifting and lowering action, the barbell weight 600 generally assumes a horizontal position; however, the barbell weight 600 can tilt and move slightly during the raising and lowering action.

FIG. 3 illustrates a third counter-weight in the form of a vessel 700 that is detachably coupled to the cable connector 310.

The vessel 700 can be in the form of a collapsible vessel, such as a jug, that can move between a fully collapsed position and a fully extended position. The fully collapsed position is a storage position. The vessel 700 is intended to be filled with a mass, such as a liquid, or a solid, such as sand. The vessel 700 has an opening through which the liquid or solid is added. The vessel 700 can have a handle or connector to which the cable connector 310 is attached for securing the vessel 700 to the cable 300. Since water and sand are readily available, this type of counter-weight is an easy low cost option that does not require purchase and storage of a typical gym weight. In addition, the degree to which the vessel 700 is filled can be varied to vary the overall weight of the counter-weight. For example, the less liquid or solid added to the vessel 700, the less it will weigh.

Another counter-weight can be in the form of a kettlebell that can be secured to the cable 300 as by using a connector. A loading pin can also be provided as part of a counter-weight and is configured such that weights can be stacked on the loading pin. The loading pin is coupled to the cable connector 310. To increase the weight of the counter-weight, more weights (plates) are located on to the loading pin.

It will be appreciated that any number of types of counter-weights can be used since the purpose of the counter-weight is to provide a mass which partially offsets the mass of the user who is attached to the other end of the cable 300.

In another embodiment, a bodyweight assist device can be designed for mounting directly to a wall as opposed to a doorway. Similar to the device 100, this device can include a support member that contains the two pulleys with cable routed therethrough. The support member is fixedly attached to a frame that is itself mounted to the wall. A counterweight is attached to one end of the cable and the other end of the cable can be attached to a harness or other attachment. The counter-weight assists the user in performing an exercise such as a pull-up or other exercise.

In yet another aspect, the device 100 that is described herein as being a bodyweight assist device can instead be considered to be a doorway multiple exercise device that allows the user to perform weight lifting exercises, much like a universal gym or other type of larger equipment found at a gym. Instead of attaching one end of the cable to a harness, the cable is attached to a piece of equipment, such as a handlebar, with the other end of the cable still being attached to the counter-weight which in this embodiment is not a counter weight but represents a weight to be driven. Various pieces of equipment that can be attached to the cable. The user grasps the attachment (e.g., handlebar) and then pulls down to lift the counter weight off the ground to exercise particular body part, such as the biceps or triceps. The user can switch the attachments to alter the difference exercises being performed.

Unlike large gym equipment, such as a universal gym, the device 10 is portable and is designed to fit within a standard doorframe and the construction allows for the passing of a cable that permits connection at one end to one or more weights and at the other end permits connection to an attachment that is attached or grasped by the user to permit exercises to be performed in which the one or more weights are lifted by the user by pulled down the cable toward the ground. The back, shoulders and arms of the user can be exercised as well as other body parts. Once the user is done, the cable is easily removed and then the device 100 is removed from the doorway. The set-up is thus easy and takes very little time. Also, the weight that is raised by the user can be in the form of the counter-weights disclosed herein and thus can take any number of different forms including those discussed and illustrated herein.

Operation of the Present Device

A person utilizing the device for developing pullup skills inserts his legs through the loops 420 and secures the harness 400 to the body. The second end 304 of the cable 3) is coupled to the harness, while the opposite first end 302 of the cable 300 is coupled to the counter-weight. The mass of the counter-weight is selected by the user with a heavier mass being selected for a beginner. For example, the counter-weight can be selected so as to counter-balance about one half of the user's weight. The user now grasps the pullup bar (either cross member 170 or the second cross mount 130), and pulls himself/herself upward by the strength of his or her arms. As the user builds up his or her strength by continued use of the device 100, the mass of the counter-weight is reduced until the user can lift his own weight and perform pullups without assistance. One will appreciate that the type of counter-weight can be changed to increase the mass of the counter-weight or the same counter-weight can be used but its mass can be increased as in the event of using vessel 700 by adding more liquid or solid to the vessel 7).

The frame 110 and its parts can be formed of any number of different materials, including but not limited to metal, rigid plastic, etc.

It will also be understood that the device 100 is not limited to being used as a device for assist a user in performing a pull-up but also can be used for weight-lifting exercises since the cable and counter-weight can be used to raise the counter-weight by pulling down on the other end of the cable. This allowed a full body workout to be easily performed. For example, when a pull-up assist mode is desired, the user attaches the cable to his/her body as by using the body harness and then grasps the frame and pulls-up, and then when other body part exercising is desired, the user detaches the body harness and attached another piece of equipment, such as a handlebar and then pulls down on this end of the cable to raise the weight (counter-weight mass).

Alternative Construction

Now referring to FIGS. 4-6B which illustrate an alternative device 1000 or system or kit that can be detachably mounted to a doorway and, like device 100, is configured to both: (1) assist a user in performing a bodyweight exercise (e.g., an assisted pull-up) and (2) allow the user to perform a wide variety of weight lifting exercises for exercising one or more body parts.

Frame

The device 1000 includes a frame 1110 that can be carried by the user and is then installed/mounted in the manner described herein. The frame 1110 includes a first cross mount (bar) 1120 that is for positioning along a first face of the doorway 10 in a first room. The first cross mount 120 can be in the form of a tubular structure that has a first end 1122 and an opposing second end 1124. As shown in the figures, the first cross mount 1120 seats against the opposing side trim 12 of the door frame 10 and more specifically, there can be two points of contact between the first cross mount 1120 and the side trim 12. The two points of contact are located along the opposing side trim 12 of the door frame 10 at or proximate the ends 1122, 1124. As shown, the first end 1122 and the second end 1124 can have protective members 1125 for the points-of-contact with the door frame 10 to avoid marking or damage. The protective members 1125 can be in the form of padding or rubber caps or the like.

The device 1000 has a second cross mount (bar) 1130 that is for positioning along the first face of the doorway 10 in the first room. Like the first cross mount 1120, the second cross mount 1130 can be in the form of a tubular structure that has a first end 1132 and an opposing second end 1134. As shown in the figures and during use, the second cross mount 1130 is positioned in spaced relationship to the opposing side trim 12 of the door frame 10. In other words, unlike the first cross mount 1120, the second cross mount 1130 does not seat directly against the side trim 12. Ends of the second cross mount 1130 can include protective (grip) members 1135 which are typically different in form and/or material than the protective members 1125. For example, the protective members 1135 can be in the form of foam or rubber sleeves that can be gripped by the user.

The second cross mount 1130 is positioned above the first cross mount 1120 during use and in particular, when the device 1000 is mounted to the doorway. As shown, the second cross mount 1130 has a greater length than the first cross mount 1120.

The first and second cross mounts 1120, 1130 are attached to one another with a pair of vertical supports 1140 that fixedly attach the first and second cross mounts 1120, 1130 to one another. The first and second cross mounts 1120, 1130 can be tubular in form. The vertical supports 1140 are preferably located between both the protective members 1125, 1135.

The vertical supports 1140 also serve as a base for a pair of pivotable supports 1150. As shown, each pivotable support 1150 can pivot between a retracted position (storage position) and an extended position (in-use position). The pivotable support 1150 includes a base sleeve 1152 that is disposed about one of the vertical supports 1150 and can freely rotate thereabout. The base sleeve 1152 can be round tubular structure. A first side support 1154 extends outwardly from the base sleeve 1152 near a bottom end thereof and has a curved distal end 1155. The curved distal end 1155 turns upward. At the end of the curved distal end 1155, a bumper 1160 is provided. The bumper 1160 is formed of an elastic material, such as rubber, and is configured to sit along the ledge 22 of the top casing 20 along the second face of the doorway 10 in a second room or space. As shown, the two bumpers 1160 seat against the wall located about the top casing 20. The curved nature of the first side support 1154 is designed to allow the pivotable support 1150 to pass into the second room (from the first room) and then curves upwardly to allow the bumper 1160 to sit along the ledge 22 and contact the wall above the top casing 20.

There is a second side support 1157 that extends outwardly from the base sleeve 1152 near a top end thereof and attaches at its opposite end to the first side support 1154. The first side support 1154, second side support 1157 and the base sleeve 1152 define an open triangular space.

In the retracted position, the two pivotable supports 1150 pivot into the open space between the first and second cross mounts 1120, 1130, thereby providing a compact footprint that allows the device 1000 to be easily carried and stored. In the retracted position, the two pivotable supports 1150 are pivoted outwardly so that they assume a position that is generally at a 90 degree angle relative to first and second cross mounts 1120, 1130.

Door Frame Supports

Figure 6A:
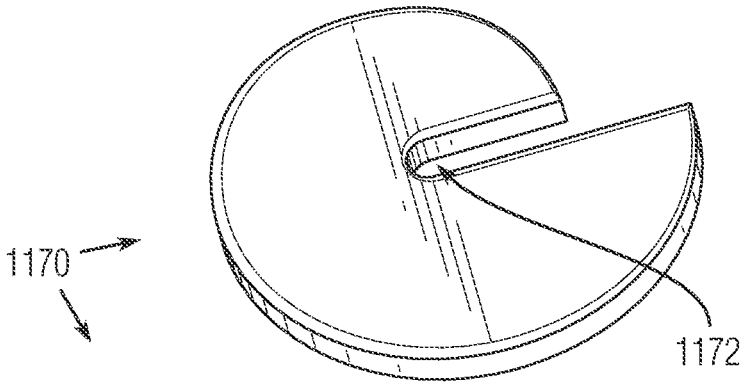
FIGS. 6A and 6B illustrate are perspective view of door frame supports that form part of the exercise device.
Figure 6B:
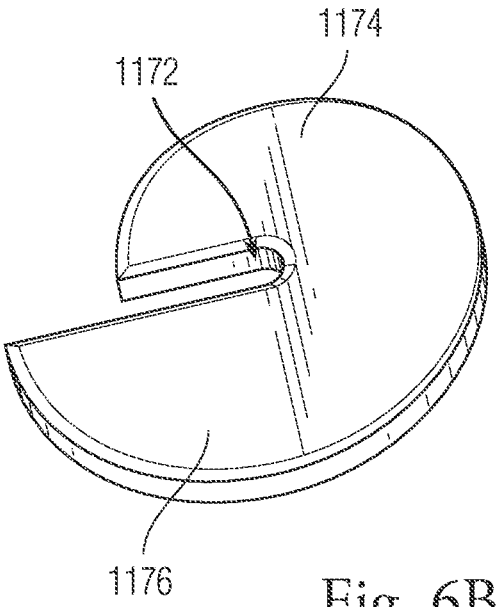

As shown especially in FIGS. 6A and 6B, the device 1000 includes door frame supports 1170 that serve as stabilizing members that stabilize the device since door frame support is desired since the device 1000 disclosed herein requires a solid connection from the device to the doorway. The devices disclosed necessarily requires weight to be placed on the opposite side of the device, making it unstable without additional support.

The door frame supports 1170 have been added to stabilize the device using the underside of the door frame and more particularly, by placing a rigid piece, in this case, the door frame supports 1170, between the device and the door frame. The illustrated door frame support 1170 has a form in the shape of a scroll. More specifically, the door frame support 1170 has a slot 1172 that partitions the door frame support 1170 into a first half 1174 (semi-circular) and a second half 1176 (semi-circular) with the halves 1174, 1176 having different surface areas, with the second half 1176 having a greater diameter than the first half 1174 and thus, as shown, the second half 1176 extends radially beyond the first half 1174.

The door frame support 1170 is intended to be installed on the second side support 1157 by inserting the second side support 1157 into the slot 1172. The door frame support 1170 can freely rotate about the second side support 1157 as well as slide axially along the second side support 1157 to allow positioning of the door frame supports 1170 in any number of different positions. As described herein, the door frame support 1170 is thus configured to provide a countering force to the weights being lifted which are in the same room (one the same side of the door way) as the bumpers 1160.

As shown, when the device 1000 is mounted in the doorway and the bumpers 1160 sit along the ledge 22 of the top casing 20, the door frame supports 1170 are coupled to the second side supports 1157 by inserting the second side supports 1157 into the slots 1172. The door frame supports 1170 are slide along the second side supports 1157 until the door frame supports 1170 are positioned below an underside (bottom surface) 21 of the top casing 20. The door frame supports 1170 are then rotated (spun) about the second side supports 1157 until they are wedged between the top casing 20 and the frame (i.e., the second side supports 1157) of the device 1000 resulting in further stabilization of the device 1000.

Lifting Truss

The device 1000 also includes a lifting truss 1200 that is detachably coupled to the frame and as described herein, is designed to be easily removed from the frame to allow for compact storage and/or transportation.

The lifting truss 1200 includes a first support 1210 that has a first end 1212 and an opposite second end 1214. The first support 1210 also has a first face 1211 and an opposing second face 1213. Along the first face 1211, there is a bracket 1220 that is located between the ends 1212, 1214 and can be located slightly closer to the second end 1214. The bracket 1220 can be an L-shaped bracket with a bottom leg 1221 extending outwardly from the first face 1211 such as at a 90 degree angle.

The lifting truss 1200 also has a main second support 1230 that has a first end 1232 and an opposing second end 1234. The first end 1232 is fixedly coupled to the first support 1210 and more particularly is fixedly coupled along the second face 1213. As shown, the location of the fixation between the main second support 1230 and the first support 1210 can be between the L-shaped bracket 1220 (below the bottom leg 1221) and the second end 1214. As shown, the main second support 1230 is fixedly coupled to the first support 1210 at an angle other than 90 degree.

A strut 1240 is provided and has a first end 1242 fixedly attached to the first support 1210 along the second face 1213 and a second end 1244 fixedly attached to the main second support 1230. The strut 1240 is coupled to the first support 1210 at an angle other than 90 degrees and similarly is coupled to the main second support 1230 at an angle other than 90 degrees.

Along the first support 1210 there is a first pulley 1250 and along the second main support 1230 there is a second pulley 1260. It will be appreciated that the first pulley 1250 can be of a type that can be fixedly coupled to the second main support 1230 at multiple locations (e.g., the first pulley 1250 can move longitudinally along the second main support 1230 and be locked in a desired location). As with the previous device, the two pulleys 1250, 1260 are intended to be disposed along different sides of the door way and a cable 1270 is routed along the two pulleys 1250, 1260 with the cable being connected at a first end 1272 to the counter weight and at an opposite second end 1274 to a harness 1300 that is described in greater detail below.

As with the first device 100, the ends 1272, 1274 of the cable 1270 have connectors that allow attachment of the first end 1272 to the counter weight and attachment of the second end 1274 to the harness 1300. The first end 1272 can include a first connector 1280, such as a carabiner, and the second end 1274 can include a second connector 1282 which can be a looped end of the cable or a separate connector.

As shown, the first pulley 1250 is located below the second pulley 1260.

Harness

In one exemplary embodiment, different types of harnesses can be used. One harness provides a different technique than the one described with reference to device 100 for coupling the user's body to the device. The harness can be an elongated structure having a first end and an opposing second end. The harness includes a first looped portion, an intermediate portion and a second looped portion. The first looped portion can be formed at the first end, while the second looped portion can be formed at the second end. The two looped portion and intermediate portion can be part of a single integral structure or alternatively, the first looped portion can be attached to one end of the intermediate portion and similarly, the second looped portion can be attached to the other end of the intermediate portion.

The intermediate portion has at least a first intermediate loop which can be attached to a third connector, such as a carabiner, that attaches to the second connector, such as a looped end of the cable. The third connector passes through the first intermediate loop and attaches to the second connector. As illustrated, the intermediate portion can include more than one intermediate loop and in particular can include a series of intermediate loops. The optional provision of plural intermediate loops allows for and accommodates different sized users. In particular, the selection of the intermediate loop dictates the position of the first looped portion and the second looped portion relative to the ground. In particular, selection of the highest intermediate loop which comprises the first intermediate loop positions the first looped portion higher off of the ground, while the second looped portion is lower to the ground. Selection of a lower intermediate loop causes the first looped portion to be lowered and the second looped portion to be raised. The user thus selects which intermediate loop is best for his or her body type (height). However, it will be appreciated that the intermediate portion can be formed so as to only include one intermediate loop.

The first looped portion, the second looped portion and the intermediate portion can be formed as a strap such as a nylon strap with loops formed by stitching and the like.

The second looped portion is intended to receive a foot of the user and more particularly, by positioning a foot of a first leg into the second looped portion and then stepping downward so that said foot contacts the ground, the counter weight is raised off the ground. This allows the user to easily initiate the use the of the device. Once the second looped portion is brought towards the ground and the counter weight is raised, the first looped portion is left dangling in proximity to the waist and the knee of the user. The first looped portion function as a knee harness in that it receives a knee of the user's second leg. The first looped portion is thus the primary means for supporting the user as the assisted pull-up exercise is provided. As the exercise is performed, both legs are raised off the ground surface and the assisted pull-up is performed in the manner described herein.

Thus, the harness interfaces with the user and transmits weight, through the center of mass of the user, to allow the pull-up motion to remain natural. Supporting the user from the knee is ideal for both stability and comfort. Stepping into the device with a foot loop (second looped portion) first and the knee loop (first looped portion) provides easy entry.

Assembly

As part of the assembly of the device 1000, the lifting truss 1200 is detachably coupled to the frame 1110. More particularly, the lifting truss 1200 capitalizes on the fact that the first and second cross mounts (bars) 1120, 1130 are spatially (laterally) offset from one another when the device 1000 is removably coupled to the door frame as shown. To couple the lifting truss 1200 to the frame 1110, the first support 1220 is inserted in the space between the first and second cross mounts 1120, 1130 and is positioned such that the first end 1212 of the first cross mount 1220 lies above and in front of the first cross mount 1220. The first support 1220 is located within the first room. In this position, the second cross mount 1130 extends rearwardly from the frame 1110 into the second room. The lifting truss 1200 is held securely in place as a result of the bottom leg 1221 of the bracket 1220 being positioned beneath the first cross mount 1220. In other words, the lifting truss 1200 is disposed between the two cross mounts 1120, 1130 in a diagonal manner such that the lifting truss 1200 is held in place by gravity. However, the lifting truss 1200 can be easily removed by simply disengaging the lifting truss 1200 from between the two cross mounts 1120, 1130.

The action of the device 1000 is similar to the device 100 in that any number of different counter weights can be used with it and it can be used to perform many difference exercises and is not just limited to a device to perform an assisted pull-up.

Device for Assisting a User in Performing a Bodyweight Exercise as Well as Weightlifting Exercises FIGS. 7-22 illustrate a device 2000, in accordance with another embodiment of the present invention, that is configured to assist the user in performing bodyweight exercises, such as pull-ups, push-ups, dips, etc. It will be fully appreciated that the device 2000 is also configured to allow the user to perform numerous weight training cable exercises, such as triceps push downs and lat pull downs to name a few. The versatility of the device 2000 is described herein and offers the consumer a single piece of exercise equipment that is easily mounted in a standard doorway found in the consumer's home and provides the necessary assistance that many beginning users need as they implement an exercise regimen that includes the performance of difficult body-weight exercises.

Much like the other devices, the device 2000 is configured to be removably mounted to the traditional doorway (door frame) 10 without any tools required. The attachment of the device 2000 to the doorway 10 is described herein.

Figure 7:
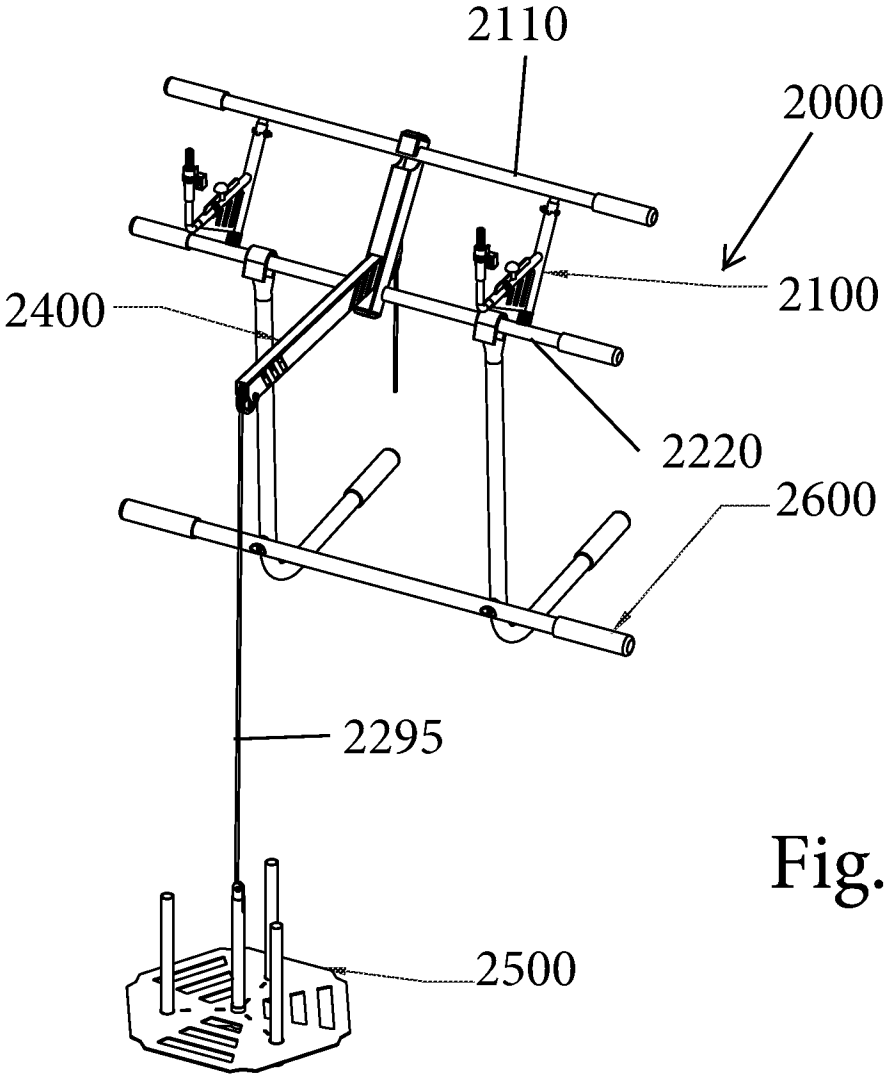
FIG. 7 is a perspective view of an exercise device in accordance with a third embodiment.
Figure 8:
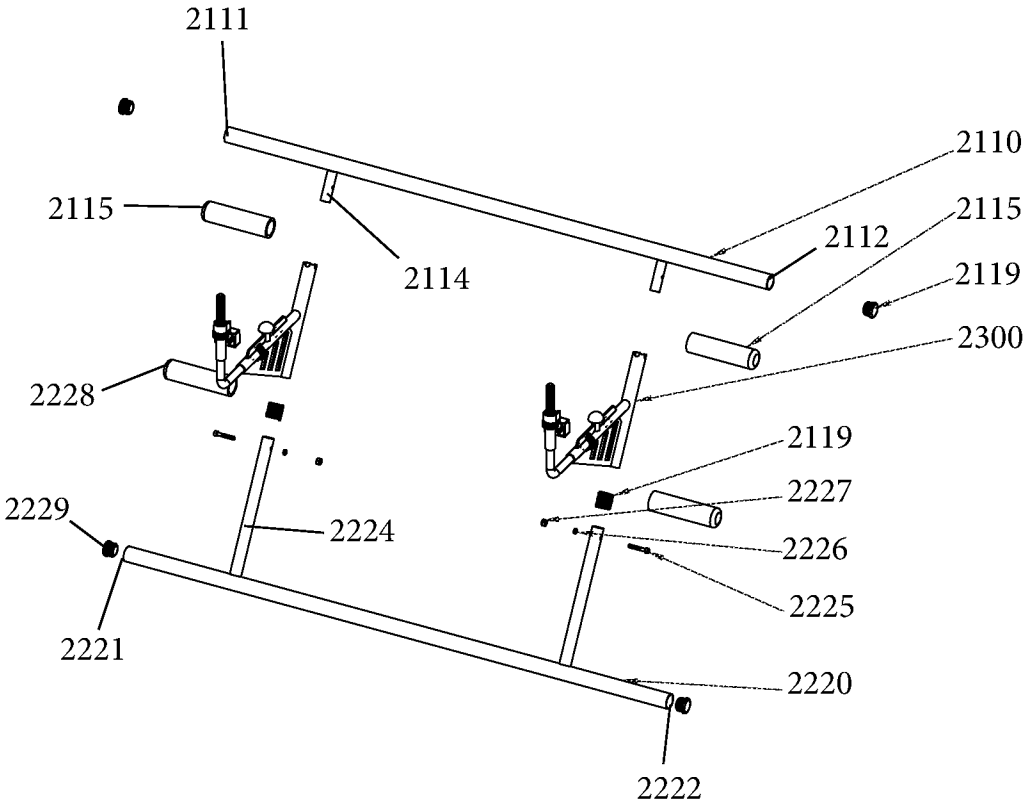
FIG. 8 is an exploded perspective view of a pull-up assembly that is part of the exercise device.

The device 2000 includes a number of subassemblies that are joined together to form the device 2000 that is shown in FIG. 7. Each of these subassemblies are described below in detail.

Pull-Up Bar Assembly 2100

The device 2000 includes a pull-up bar assembly 2100 that is part of the main frame of the device 2000. The pull-up bar assembly 2100 is best shown in FIGS. 7-13 including FIG. 8 which is an exploded view of the pull-up bar assembly 2100. The pull-up bar assembly 2100 includes a first door bar (first cross mount) 2110 and a second door bar (second cross mount) 2220 that in use is located below the first door bar 2210. As will be described herein, the first door bar 2110 and the second door bar 2220 are both located along the same side of the doorway 10.

The first door bar 2110 has an elongated portion that has a first end 2111 and an opposing second end 2112. The first door bar 2110 has a pair of protrusions (stubs) 2114 that extend downwardly from the elongated portion. A pair of first grips 2115 are disposed on the first end 2111 and the second send 2112 of the elongated portion. The first door bar 2110 can be formed of a metal material, while the first grips 2115 can be formed of a polymeric material or rubber or other suitable material. As illustrated, the first door bar 2110 can be a tubular structure. As described herein, to perform a pull-up, the user grasps the first door bar 2110 by grasping the first grips 2115. End caps 2119 can be used to close off the ends 2111, 2112.

The second door bar 2220 also has an elongated portion that has a first end 2221 and an opposing second end 2222. The second door bar 2220 has a pair of side extensions 2224 that extend outwardly from the elongated portion of the second door bar 2220. The side extensions 2224 have greater lengths than the lengths of the stubs 2114. In use, the side extensions 2224 extend upwardly from the elongated portion of the second door bar 2220. The side extensions 2224 are configured to receive the stubs 2114 and the side extensions 2224 are joined to the stubs 2114 to attach the first door bar 2110 to the second door bar 2220. For example, fasteners can be used to attach the side extensions 2224 to the stubs 2114. The side extensions 2224 and the stubs 2114 have thru holes that are axially aligned when the stubs 2114 are received within the side extensions 2224 to allow the fasteners to join the side extensions 2224 and the stubs 2114 together, whereby the first door bar 2110 is attached to the second door bar 2220. Each fastener can be in the form of a screw 2225, a spacer 2226 and a locknut 2227. Springs 2119 are also provided and are disposed over the side extensions 2224 and in use are positioned proximate the second door bar 2220.

The combined subs 2114 and side extensions 2224 define cross supports that extend between the first door bar 2110 and the second door bar 2220.

A pair of second grips 2228 are disposed on the ends 2221, 2222 and end caps 2229 can be used to close off the ends 2221, 2222. The second grips 2228 can be the same as or different from the first grips 2115.

When assembled, the first door bar 2210 is located above the second door bar 2220 and the second door bar 2220 seats against the door frame as described herein.

Door Hook Assemblies 2300

One main component of the pull-up bar assembly 2100 is a pair of door hook assemblies 2300 that are disposed between the first door bar 2110 and the second door bar 2220. Each door hook assembly 2300 is disposed over one of the respective side extensions 2224 and when the first door bar 2110 is attached to the second door bar 2220, one end (upper end) of the door hook assembly 2300 is held in place by the fasteners, while the other end (lower end) of the door hook assembly 2300 seats against the elongated portion of the second door bar 2220. As described herein, the door hook assembly 2300 can pivot (rotate) about the respective side extension 2224. This allows the door hook assembly 2300 to be moved between a collapsed (folded) position (for transportation/storage) and an extended position. When the door hook assemblies 2300 are in the collapsed position, the door hook assemblies 2300 pivot inward toward the center regions of the first door bar 2110 and the second door bar 2220.

Figure 9:
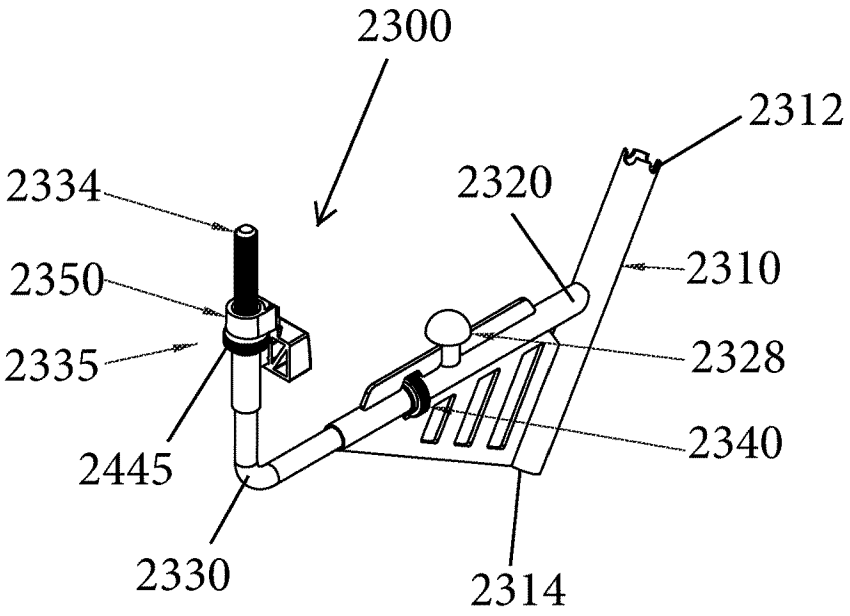
FIG. 9 is a perspective view of a door hook assembly that is part of the exercise device.
Figure 10:
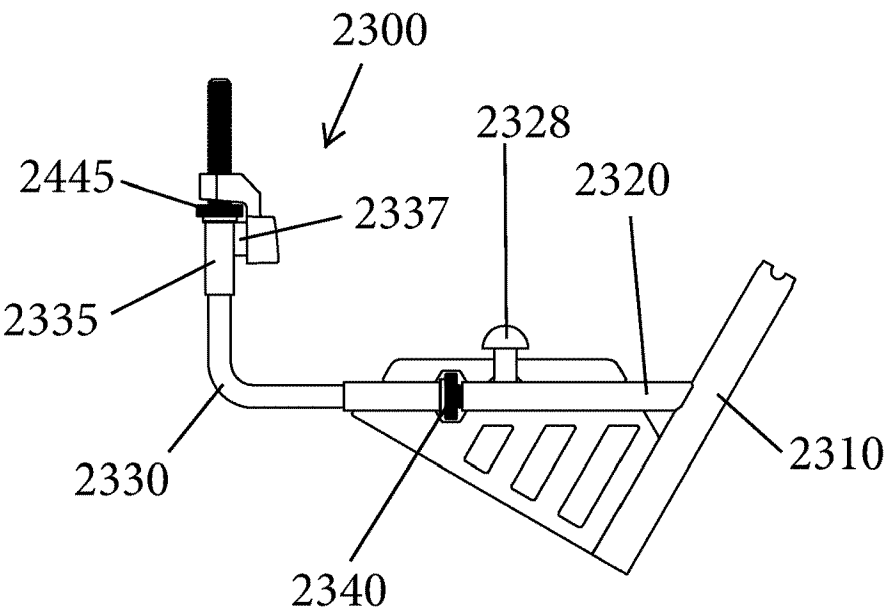
FIG. 10 is a side elevation view of the door hook assembly.
Figure 11:
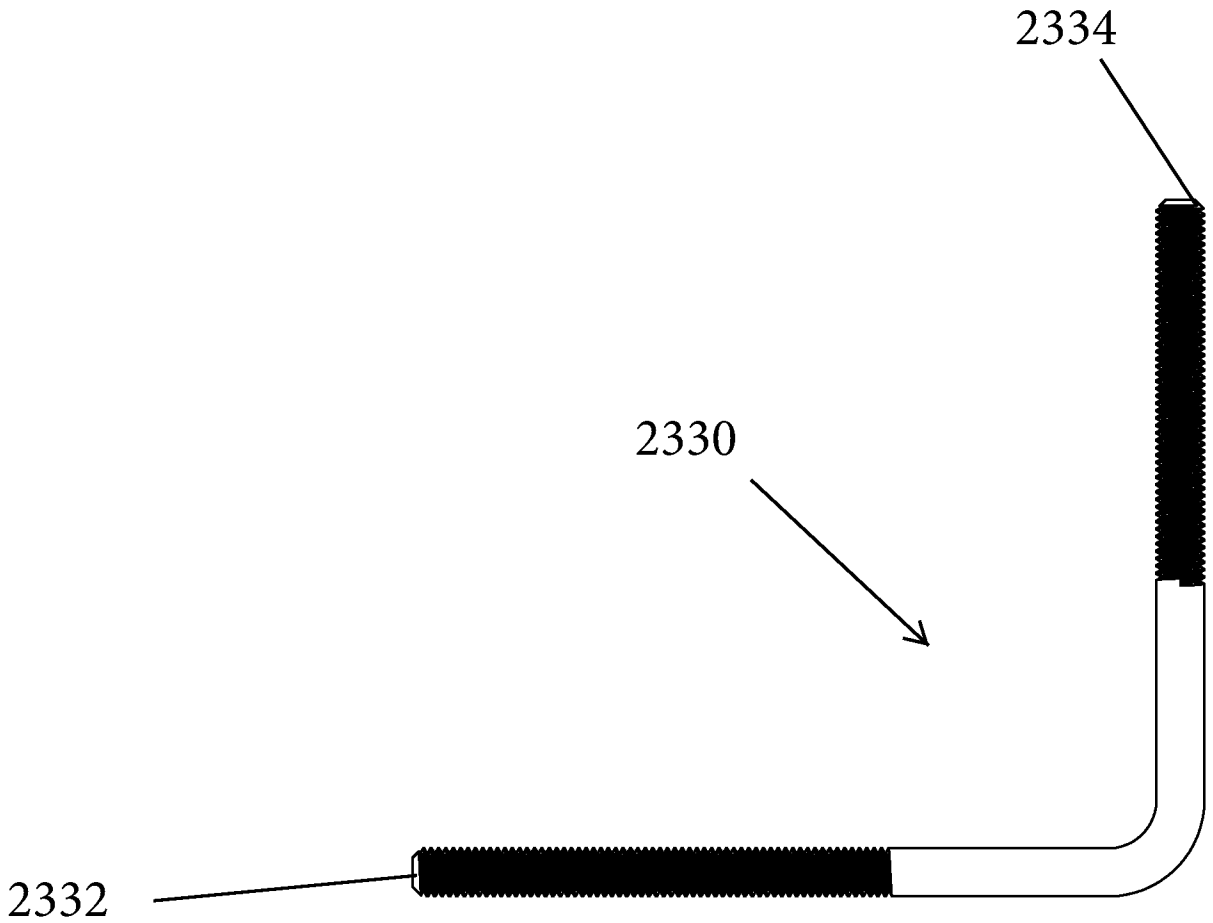
FIG. 11 is a side elevation view of elbow component that is part of the door hook assembly.
Figures 12, 13:
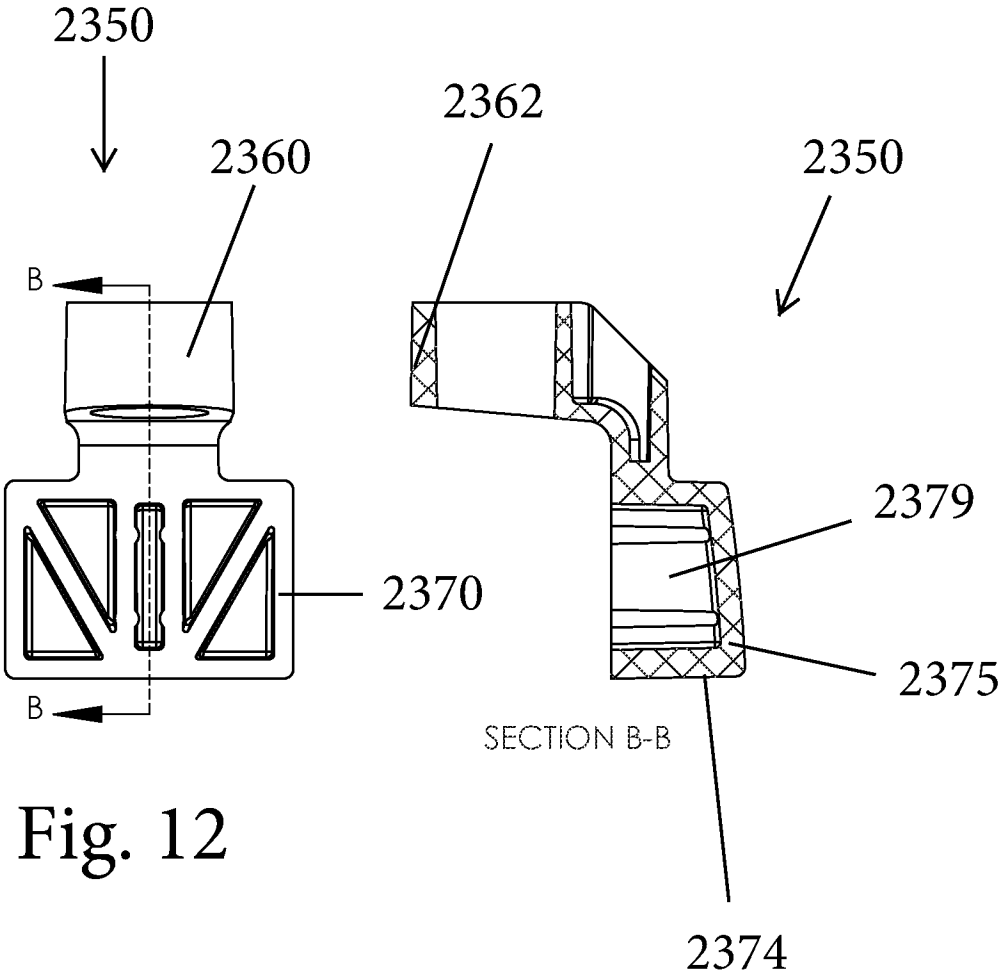
FIG. 12 is a front elevation view of a door gripper that is part of the door hook assembly.
FIG. 13 is a cross-sectional view taken along the line B-B of FIG. 12.
Figure 14:
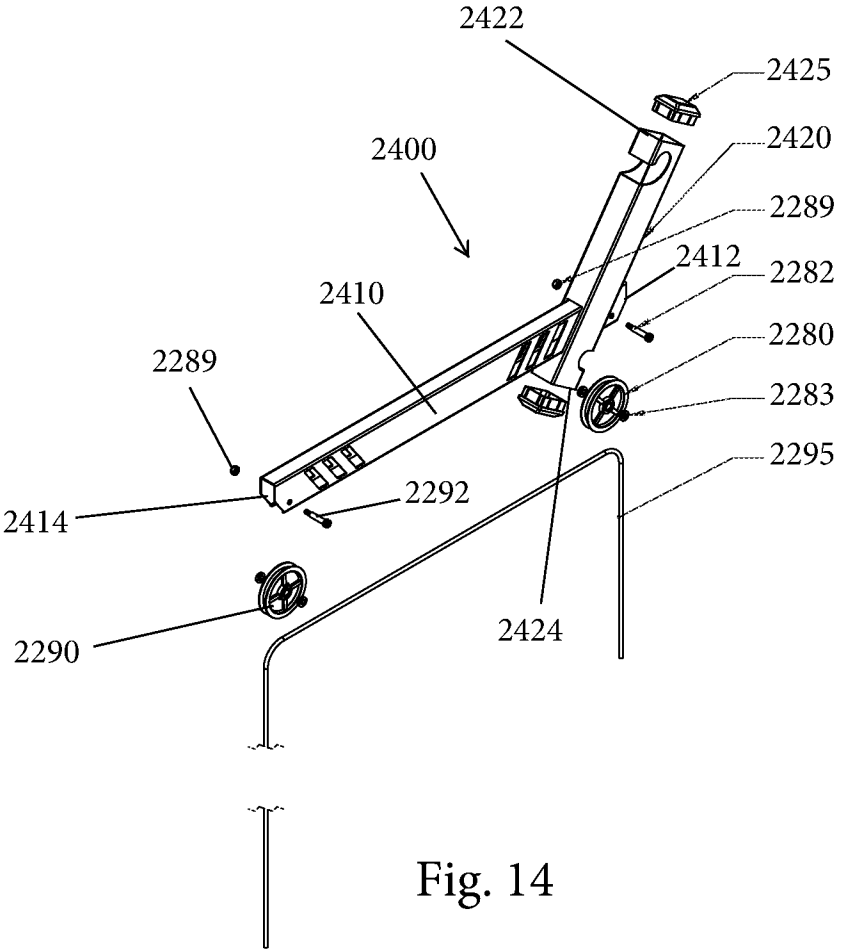
FIG. 14 is an exploded perspective view of a pulley carrier assembly.
Figure 15:
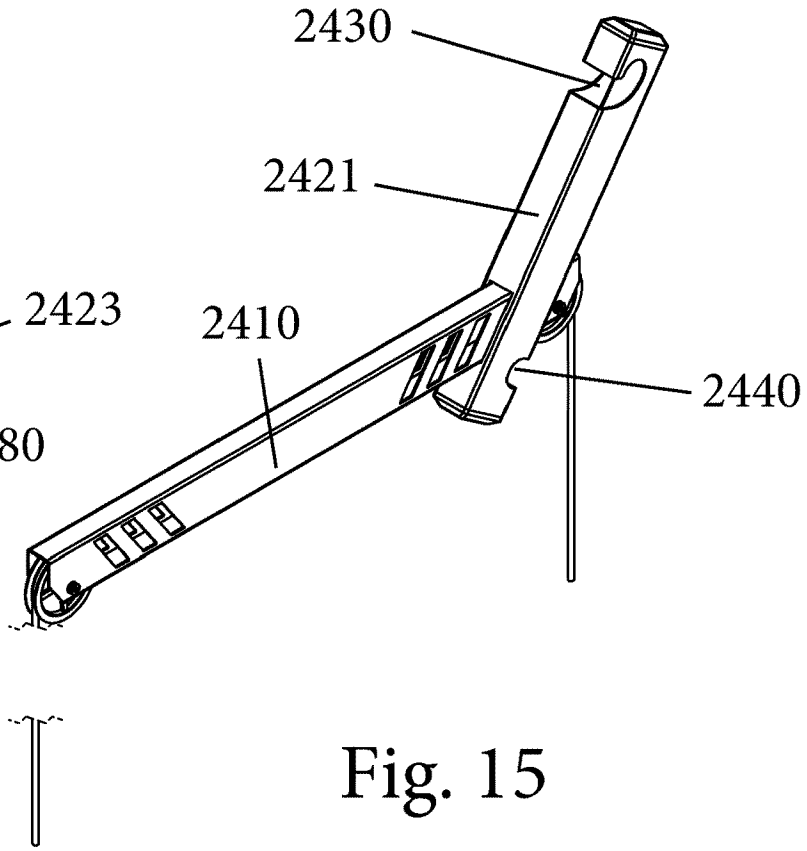
FIG. 15 is a side perspective view of the pulley carrier assembly.
Figure 16:
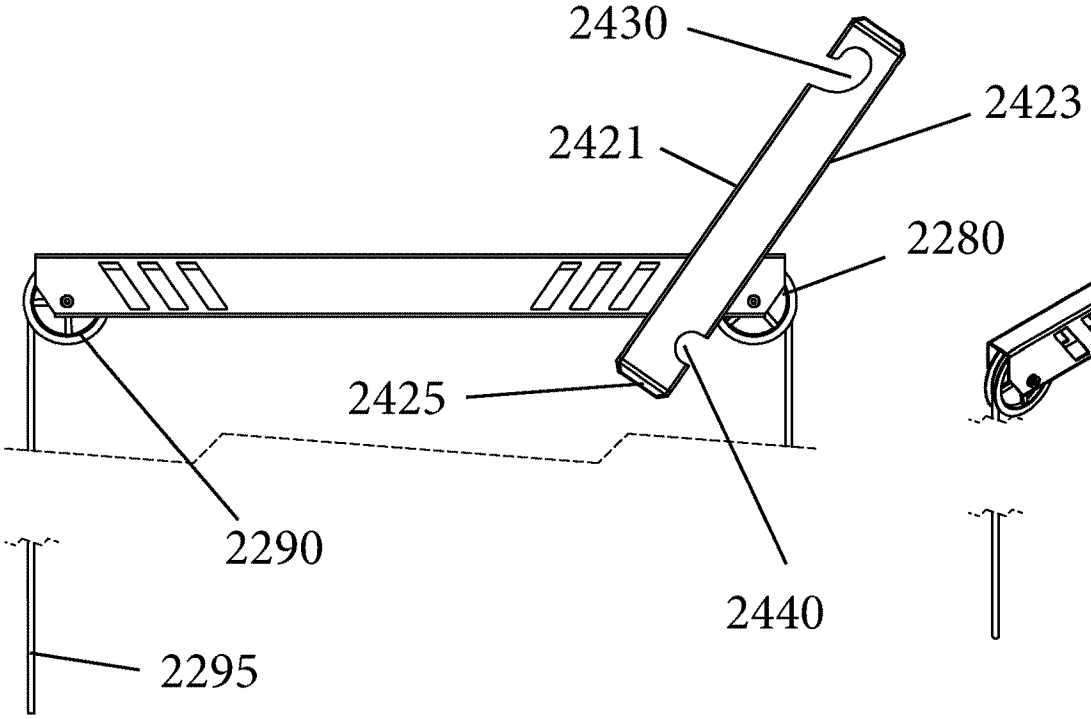
FIG. 16 is a side elevation view thereof.

FIGS. 9-11 best illustrate the construction of the door hook assembly 2300. The door hook assembly 2300 includes a hollow frame member 2310 (e.g., a tubular structure) with a first end 2312 and an opposing second end 2314. The door hook assembly 2300 also include a hollow cross frame member 2320 (e.g., tubular structure) that connects at a first end 2322 to the hollow frame member 2310. Along the topside of the cross frame member 2320 there is a fixed bumper 2328. The bumper 2328 can have a mushroom shape with a stem that is joined to the hollow cross frame member 2320 and a top round portion. Between the cross frame member 2320 and the hollow frame member 2310 there is a structural fin (triangle gusset).

The device 2000 is configured such that when the frame (pull-up bar assembly) is secured to the doorway and raised towards the top of the doorframe, the bumper 2328 pushes into the top casing 20 of the doorframe (doorway). This action creates a natural locking system so that the pull-up bar assembly becomes sturdier and more stable in the door-frame.

The bumper 2328 can be formed of any number of suitable resilient material including but not limited to rubber.

The door lock assembly 2300 has a pull-up bar elbow 2330 that has a first end 2332 along a first leg and an opposite second end 2334 along a second leg. The first end 2332 comprises a threaded end (outer threads) and similarly, the second end 2334 comprises a threaded end (outer threads). The first end 2332 is inserted into the hollow cross frame member 2320. The first leg is thus coaxial to the hollow cross frame member 2320. The pull-up bar elbow 2330 is adjustable relative to the hollow cross frame member 2320 and more particularly, a thumb nut 2340 is used to connect the pull-up bar elbow 2330 to the hollow cross frame member 2320. In particular, the thumb nut 2340 engages the outer threads at the first end 2332 of the pull-up bar elbow 2330. Rotation of the thumb nut 2340 causes the pull-up bar elbow 2330 to either be retracted or extended from the hollow cross frame member 2320. This action (movement of the pull-up bar elbow 2330) is used to engage the door hook assembly 2300 to the doorway 10. The rotation of the thumb nut 2340 thus adjusts the length of the first leg that is exposed beyond the end of the hollow cross frame member 2320.

A door finger 2335 is provided and includes a tubular portion that is disposed over and received the second leg of the pull-up bar elbow 2330. The door finger 2335 includes an outwardly extending finger or flag 2337.

A door gripper 2350 is attached to the second leg of the door hook assembly 230 and, as described herein, is configured to engage the ledge 22 of the top casing 20 along the first face of the doorway 10 (FIG. 22) for securing the device 2000 to the doorway 10. As best shown in FIGS. 9-11 and 22, the door dripper 2350 has a first portion 2360 that is configured to engage the second end 2334 of the pull-up bar elbow 2330 and a second portion 2370 that is configured to engage the ledge 22. The first portion 2360 has a bore 2362 formed therein such that the first portion 2360 receives the outer threaded second end 2334 of the pull-up bar elbow 2330. The location of the door gripper 2350 on the second leg of the pull-up bar elbow 2330 is thus adjustable by screwing or unscrewing the door gripper 2350 relative to the second leg. The second portion 2370 of the door gripper 2350 is in the form of a gripper body 2372 that has a flat bottom surface 2374 and an angled outer surface 2375. The flat bottom surface 2374 can seat against the top surface of the ledge 22, while the angled outer surface 2375 can seat against the wall. The orientation of the first and second portions 2360, 2370 is such that when the door gripper 2350 is threaded onto the second leg, the flat bottom surface 2374 remains parallel to the top surface of the ledge 22 and this allows the flat bottom surface 2374 to be driven into contact and engagement with the top surface of the ledge 22.

The finger 2337 of the door finger 2335 is received into the hollow rear space 2379 of the second portion 2370 of the door gripper 2350 to provide stability to the door gripper 2350.

The door gripper 2350 can be in the form of a plastic molded part.

A thumb screw 2445 is located between the first portion 2360 of the door gripper 2350 and the body of the door finger 2335 and is used to adjust the position of the door gripper 2350 along the second leg. Since the door finger 2335 is connected to the door gripper 2350 by means of the finger 2337, downward movement of the thumb screw 2445 drives the door finger 2335 downward causing the door gripper 2350 to likewise move downward. The reverse upward motion of the thumb screw 2445 applies an upward force to the first portion 2360 of the door gripper 2350 causing upward movement of the door gripper 2350 and once again, since the door gripper 2350 is connected to the door finger 2335, the door finger 2335 is also drawn upward. The thumb screw 2445 is thus the means for causing the door gripper 2350 to move in both an upward direction and a downward direction along the second leg of the elbow 2330.

The springs 2119 bias the door hook assemblies 2300 upward on the side extensions 2224. To rotate the door hook assemblies 230 between the collapsed and extended positions, the door hook assemblies 2300 can be pushed down along the side extensions 2224 causing compression of the springs 2119. The first end 2312 of the hollow frame member 2310 can be contoured to engage and lock to the first door bar 2110. More specifically, the first end 2312 can include a series of notches that are radially spaced about the first end 2312 and in particular, there are two pairs of notches. The notches of each pair are 180 degrees apart. These notches are semi-circular shaped so that they can seat against and receive the first door bar 2110 and also lock the door hook assembly in place since the frame member 2310 cannot rotate relative to the first door bar 2110 when the door hook assembly 230 is locked in place. To disengage the door hook assemblies 2300, the frame member 2310 is pushed down compressing the spring 2119 and disengaging the first end 2312 of the frame member 2310 from the first door bar 2110.

Pulley Carrier Assembly 2400

The device 2000 also includes a pulley carrier assembly 2400 that is detachably coupled to the first door bar 2210 and the second door bar 2220.

As shown in FIGS. 7 and 14-16, the pulley carrier assembly 2400 includes a carrier 2410 and a support bar hook 2420 with an angle of greater than 90 degrees being formed between the carrier 2410 and the support bar book 2420. The carrier 2410 is a hollow elongated member that has a first end 2412 and an opposing second end 2414. The carrier 2410 can have a U-shape and have open slots formed therein between the two ends 2412, 2414. Each of the first end 2412 and the second end 2414 is an open end and each side wall of the carrier 2410 includes a hole at each of the ends 2412, 2414 that is aligned with the respective hole in the other side wall to allow an axle to pass therethrough as described below.

The support bar hook 2420 is defined by a first end 2422 and a second end 2424. The support bar hook 2420 can be a hollow shaped structure that can have a square cross-sectional shape. The first and second ends 2422, 2424 are open ends that can be closed off using end caps 2425. The support bar hook 2420 thus has a first end wall 2421 and an opposing second end wall 2423 with two side walls extending therebetween.

Between the first end 2422 and the second end 2424, there is a through hole that is defined by openings (slots) formed within the end walls of the carrier 2410. This through hole is sized and shaped to allow the carrier 2410 to pass through the support bar hook 2420. In the assembled position, a majority of the length of the carrier 2410 is located on one side of the support bar hook 2420 and in particular, a substantial length of the carrier 2410 extends outwardly from the first end wall 2421, while only the second end 2414 of the carrier 2410 extends outwardly from the opposite second end wall 2423.

Along the first end wall 2421, there is a first opening (first slot) 2430 that is formed proximate the first end 2422 and along the second end wall 2423, there is a second opening (second slot) 2440 that is formed proximate the second end 2424. The first slot 2430 is thus formed by cut outs formed in the opposing side walls of the support bar hook 2420 and the second hook 2440 is formed by cut outs formed in the opposing side walls.

The shapes of the first slot 2430 and the second slot 2440 are different.

The first slot 2430 can generally be a dog leg shape slot in that the first slot 2430 has an entrance along the first end wall 2421 and then curves upward toward the first end 2422 of the support bar hook 2420. The end of the first slot 2430 is rounded. The support bar hook 2420 is intended to be hung on the first door bar 2210 by receiving the first door bar 2210 into the first slot 2430. The rounded end of the first slot 2430 has a complementary shape to the tubular first door bar 2210.

The second slot 2440 can have a semi-circular shape (C-shape) that has a closed rounded end. The second slot 2440 is complementary to the second door bar 2220 and is intended to receive the second door bar 2220 as the support bar hook 2420 is pivoted about the first door bar 2210 and into engagement with the second door bar 2220.

A first pulley 2280 is disposed at the first end 2412 of the carrier 2410 and can be joined to the carrier 2410 using a first axle 2282 that can be in the form of a fastener that passes through the openings formed in the side walls of the carrier 2410. Spacers 2283 can also be used as well as a lock nut 2289. A second pulley 2290 is disposed at the second end 2414 of the carrier 2410 and can be joined to the carrier 2410 using a second axle 2292 that passes through openings in the side walls of the carrier 2410. Spacers 2283 can also be used with the second axle 2292. The first and second pulleys 2280, 2290 are thus disposed within the inner channel formed within the hollow shell of the carrier 2410. The arrangement positions a pulley at each end of the carrier 2410. A cable 2295 is routed about the first and second pulleys 2280, 2290 and within the hollow channel of the carrier 2410.

One of the advantages of the configuration of the pulley carrier assembly 2400 is that it is not fixedly connected to the first door bar 2210 and the second door bar 2220. The pulley carrier assembly 240 is thus suspended and coupled to the first door bar 2210 and the second door bar 2220 by the construction of the support bar hook 2420. Once again, the pulley carrier assembly 2400 can be easily attached to and easily and quickly detached from the first door bar 2210 and the second door bar 2220 by the shape of the first slot 2430 and the spaced positioning of the two door bars 2210, 2220.

The pulley carrier assembly 2400 is held in place by its own weight since it is suspended in a diagonal orientation such that it is located one side (outer side) of the first door bar 2210 and is also located on one side (outer side) of the second door bar 2220. This orientation allows the suspension of the pulley carrier assembly 2400 without any direct fastening to the first and second door bars 2210, 2220.

Weight Platform Assembly 2500

Figure 18:
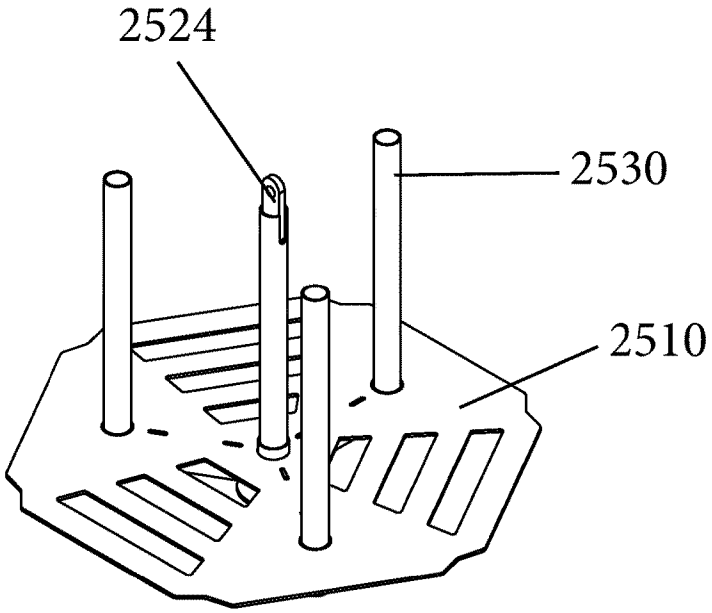
FIG. 18 is a perspective view of the assembled weight platform assembly.
Figure 17:
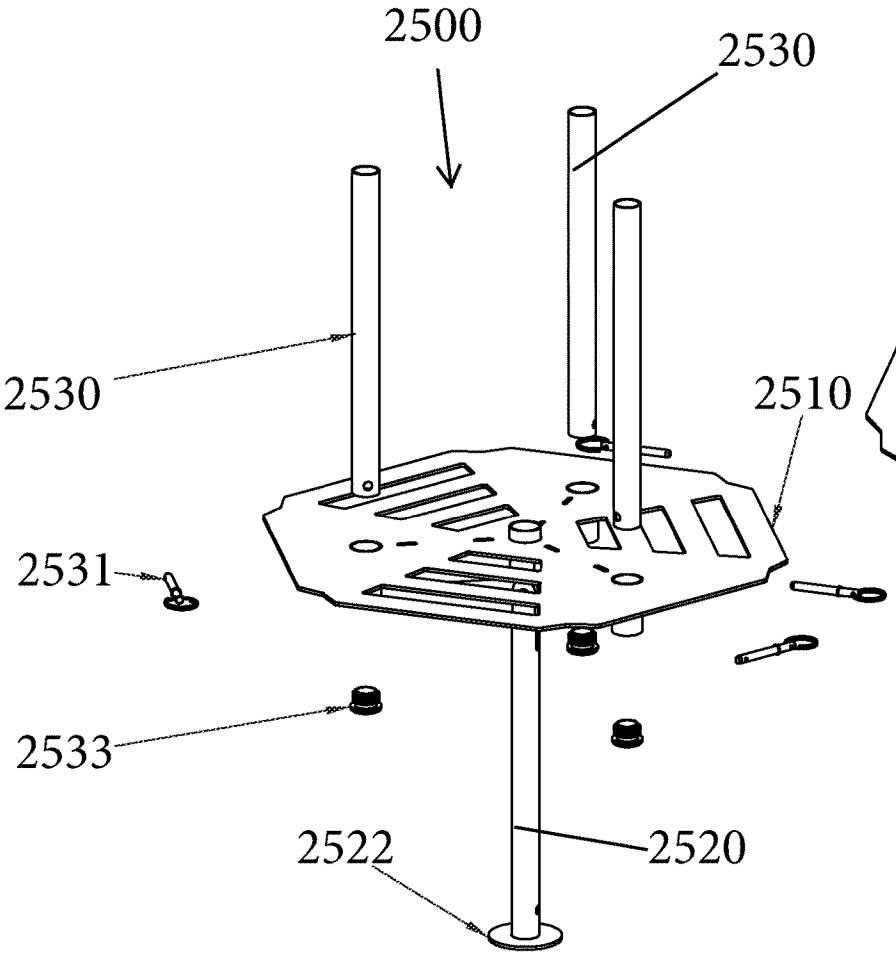
FIG. 17 is an exploded perspective view of a weight platform assembly that is part of the exercise device.

As shown in FIGS. 17-18, the weight platform assembly 2500 includes a base plate 2510 that can be in the form of a shaped, flat plate that has a bottom face and an opposite upper face. As illustrated, the base plate 2510 can have a hexagon shape and can have a number of openings (slots) formed therein to reduce weight.

The weight platform assembly 2500 includes a main center pin 2520 that passes through a center opening formed through the base plate 2510. The main center pin 2520 includes a bottom flange 2522 at a lower end thereof and has a finger 2524 that an opposite upper end thereof. The finger 2524 can have a through hole formed therein. One end of the cable 2295 is coupled to the finger 2524 as by passing the cable 2295 through the hole in the finger or attaching the end of the cable 2295 to a connector (e.g., carabiner) that is then detachably connected to the finger 2524 by passing through the through hole.

The weight platform assembly 2500 includes one or more secondary pins 2530. The secondary pins 2530 can be elongated rods that are detachable coupled to the base plate 2510. For example, fasteners 2531, such as quick release pins, can be used. In addition, end caps 2533 can be used to close off the bottom ends of the secondary pins 2530. The secondary pins 2530 are disposed radially outward from the main center pin 2520. The main center pin 2520 and the secondary pins 2530 stand upright and are perpendicular to the base plate 2510. The secondary pins 2530 can be located equidistant from one another. The spacing of the secondary pins 2530 is such that weights can be stacked on each secondary pin 2530 at the same time. The secondary pins 2530 are thus configured to receive donut type weights that have a center hole which can receive the donut type weight. In one embodiment, the donut type weight can be a collapsible weight can receive water which adds mass to the weight. A plurality of weights (e.g., 4) can be stacked on each secondary pin 2530. In this manner, weight is added to the base plate 2510 and acts as a counterweight to the user's weight as described herein.

The base plate 2510 can be formed of a metal.

Dip Bar Assembly 2600

Figure 19:
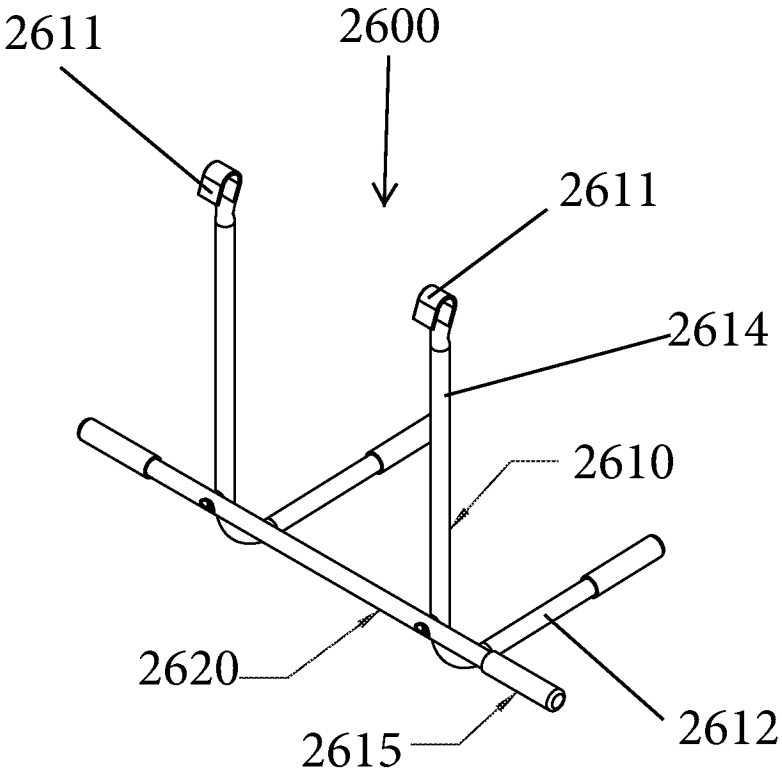
FIG. 19 is a dip bar assembly.

As shown in FIG. 19, the dip bar assembly 2600 includes a pair of dip bars 2610 that are spaced apart and are connected to one another by a cross bar 2620. Each dip bar 2610 is L-shaped and includes a first leg 2612 and a second leg 2614 that is formed at a right angle relative to the first leg 2612. An upper end of each dip bar 2610 is a curved end that resembles a hook 2611. The two dip bars 2610 are connected to one another by the cross bar 2620 that extends across the fronts of the dip bars 2610. The length of the cross bar 2620 is such that it extends beyond the dip bars 2610 and grips 2615 can be disposed at the two ends of the cross bar 2620.

As shown in FIG. 19, the dip bar assembly 260 is detachably coupled to the second door bar 2220 by hanging the dip bar assembly 2600 from the second door bar 2220. The hooks 2611 at the upper ends of the two dip bars 2610 are hung onto the second door bar 2220 between the grips 2228 disposed thereon. When hung, the first legs 2612 face toward the first door bar 2210 and the pulley carrier assembly is located between the dip bars 2610.

The spaced apart first legs 2612 represents the bars that the user grasps and positions his or her body between these first legs 2612 to perform a dip. The user can grasp the dip bar assembly 2600 using the grips 2615.

The length of the second door bar 2220 and the cross bar 2620 is preferably the same or similar since when installed the ends of the cross bar 2620 seat against the door frame to provide stability to the dip bar assembly 2600.

The user only attaches the dip bar assembly 2600 when it is desired to perform a dip otherwise it is easily removed.

Pulldown Tube 2700

Figure 20:
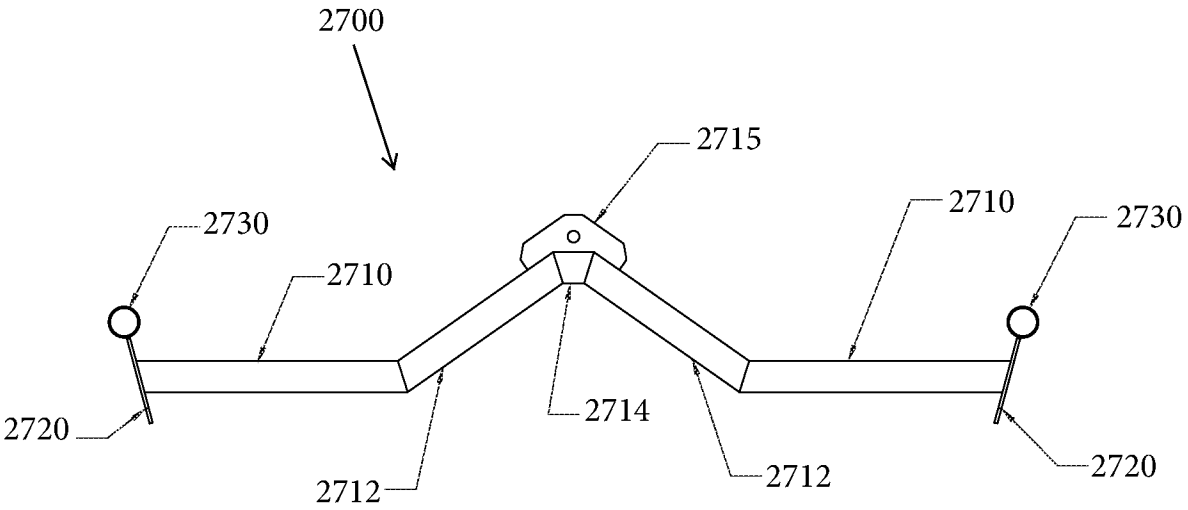
FIG. 20 is a pulldown bar assembly.
Figure 21:
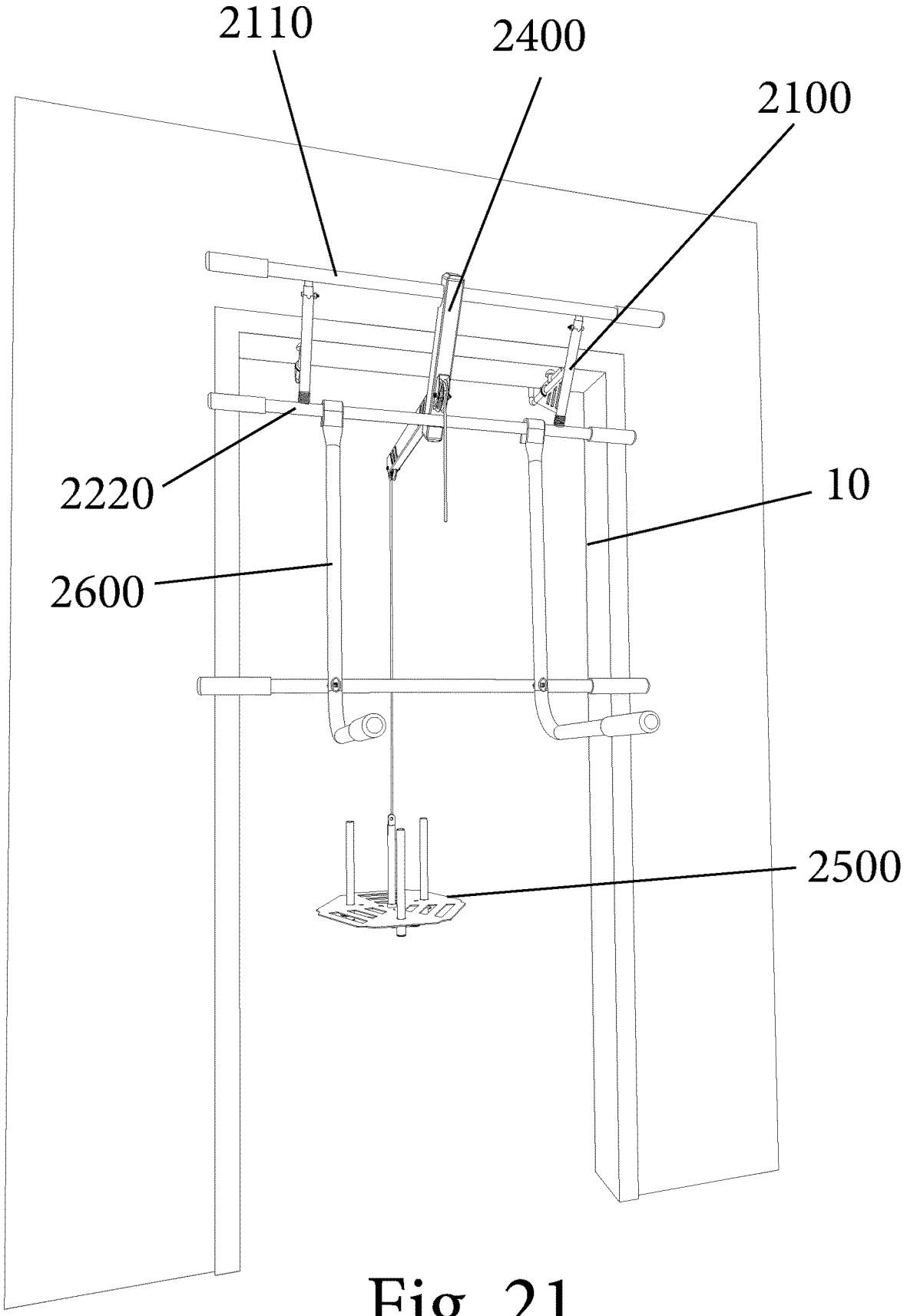
FIG. 21 is a perspective view of the exercise device mounted to a doorway.

FIG. 20 illustrates a pulldown tube 2700 that is an elongated structure that has a bent center portion. The tube 2700 has straight end sections 2710 that lead to angled sections 2712 that terminate at a tube center section 2714. At the center section 2714, there is a center bracket 2715 that has a hole formed therethrough. At the ends of the straight end sections 2710, there are endplates 2720. The endplates 2720 can be connected to the ends of the end sections 2710 at an angle other than 90 degrees. Along a top edge of the end plate 2720 there is a tube handle 2730 which is in the form of a hollow tube that is orientated perpendicular to the axis of the straight end sections 2710.

The pulldown tube 2700 is attached to a first end of the cable 2295. A user can perform a pulldown exercise by grasping the tube 2700, typically the angled section 2712 thereof, and then pulling down on the tube 2700 to exercise the triceps muscles.

Bodyweight Resistance Straps/Harness 2800

Figure 23:
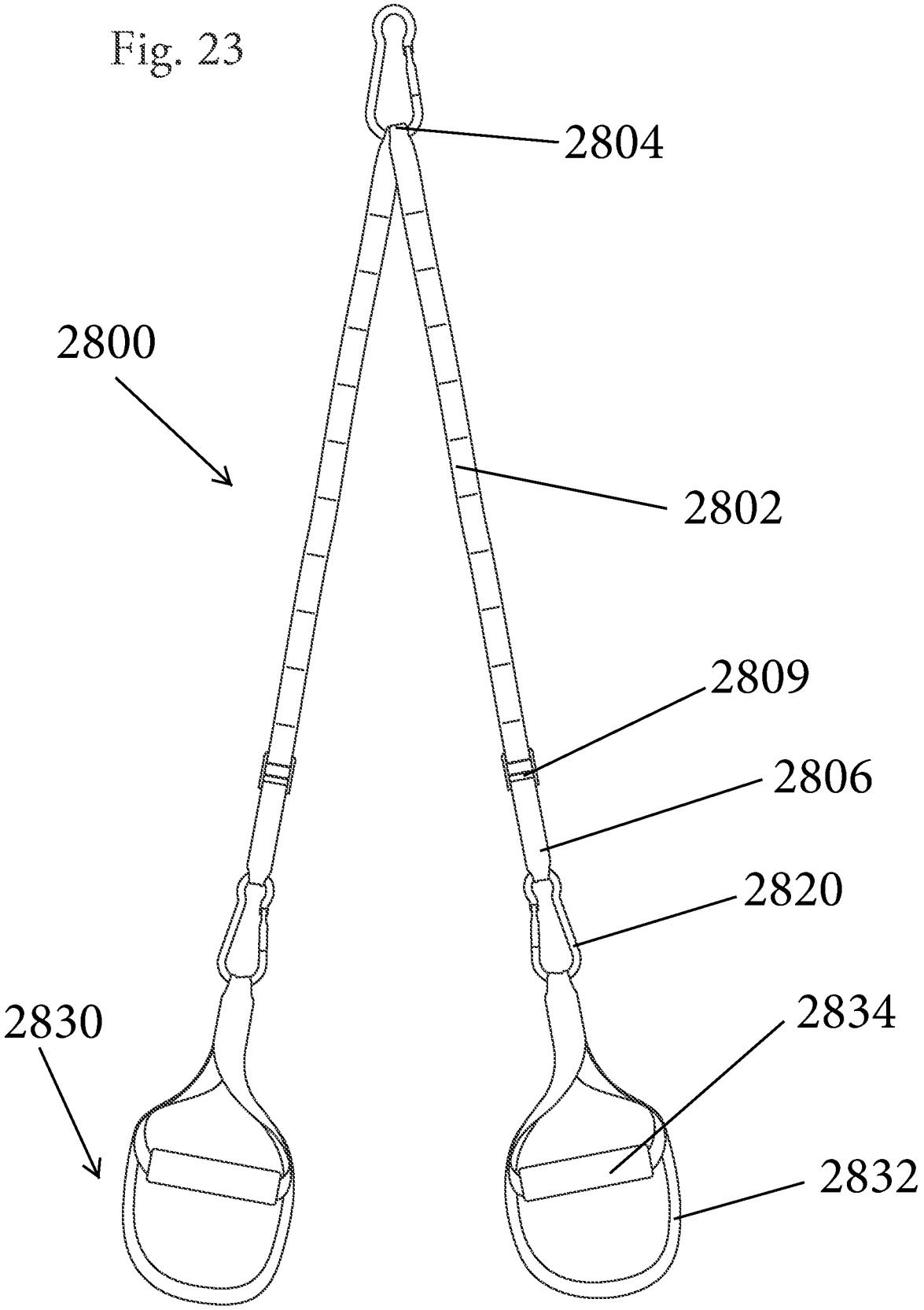
FIG. 23 is a front elevation view of a pair of exercise straps configured for being held by the user or secured to the user's foot or knee.

FIG. 23 depicts a pair of bodyweight resistance training straps 280 that when combined together can represent a harness of the like. Each strap 2800 has an adjustable length main body 2802 that has a first end 2804 and an opposing second end 2806. The first end 2804 can have a first connector or the like or be in the form of a looped end that is configured to attach to a user end of the cable 2295 (e.g., using a carabiner or the like). The second end 2806 has an adjustable part 2809 that permits the overall length of the main body 2802 to be altered. Indicia, such as numbering, can be provided along the length of the main body 2802 to indicate different lengths of the main body 2802 or different positions of the main body 2802. The part 2809 can be in the form of a ratchet or toothed buckle or the like. The use of the ratchet or similar mechanism allows the length of the main body 2802 to be altered.

The part 2809 is also configured so that a lower strap 2810 is attached thereto. The lower strap 2810 can be attached to the part 2809 at the upper end thereof and can have a looped lower end that permits a second connector 2820 to attach thereto. The second connector 2820 can be in the form of a carabiner or the like. A handle 2830 can be attached to the second connector 2820. The handle 2830 can comprise a double loop in that the handle 2830 can have an outer strap 2832 and within the outer strap 2832, there is a handle 2834. The handle 2830 and outer strap 2832 come together at a top section that is configured to attach to the second connector 2820. The handle 2830 can be formed of a rigid handle bar, while the outer strap 2832 is a fabric strap.

As described herein, the user will use either the rigid handles 2830 or the outer straps 2832 depending upon the exercise that is being performed. The outer straps 2832 are of sufficient width to accommodate a knee or foot in order for the user to perform one of the exercises described herein.

As described herein, in at least one mode of exercise, the user attaches the two straps 2800 to a common connector that is at the user end of the cable 2295 (FIG. 7) as shown in FIG. 23. This allows the user to perform many different types of exercises including an assisted push-up in which the user grasps the rigid handles 2832 and drops to the ground and begins performing a tradition push-up. The weight of the counter-weight (weight plate) provides assistance to the user.

Method of Door Installation

As with the other devices, the device 2000 is mounted to the doorway in the following manner. The pull-up bar assembly 2100 is installed in the doorway. The door hook assemblies 2300 are unfolded from the folded, storage position and assume extended positions in which they face outwardly and forward. The second leg of the pull-up bar elbow 2330 is positioned on the second face of the door way. In order to position, the second leg in such position, a sufficient length of the first leg of the pull-up bar elbow 2330 extends beyond the tubular structure 2320. If additional extension of the pull-up bar elbow 2330 is required, the thumb screw 2340 is manipulated to cause the relative movement of the pull-up bar elbow 2330 relative to the base of the door hook assembly.

Figure 22:
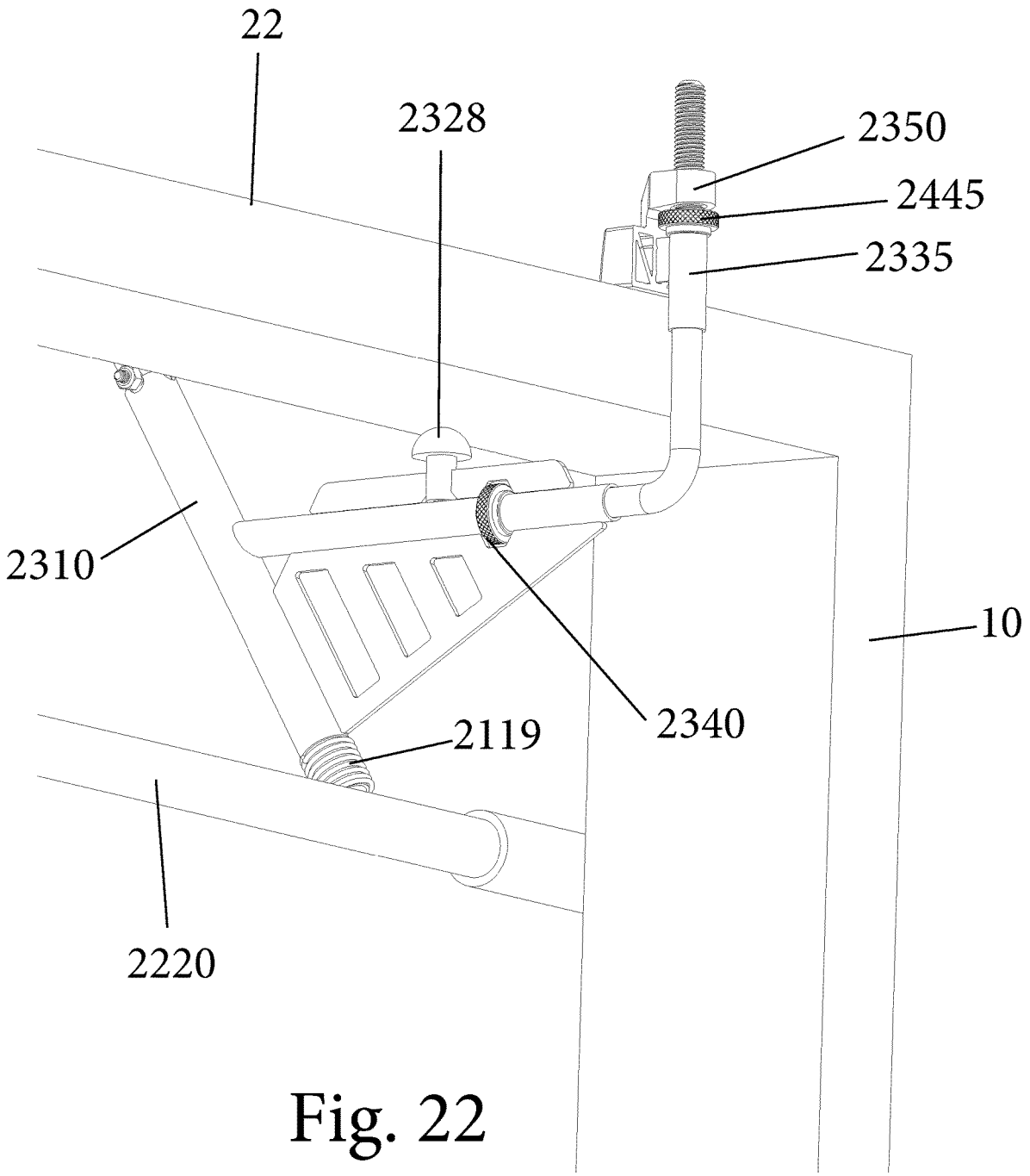
FIG. 22 is a closeup perspective view of the door hook assembly mounted to the doorway.

The door gripper 2350 is then adjusted along the second leg of the pull-up bar elbow 2330 using the thumb screw 2445 until the second portion 2370, which is in the form of a gripper block, engages the ledge 22 of the doorway. As shown in FIG. 22, in this engaged position, the second portion 2370 seats against the top edge of the ledge 22.

In this initial position, the bumper 2328 is below but spaced from the underside of the top casing 20 and the first leg of the elbow 2330 is not parallel to the ground surface. The user then adjust the thumb screw 2340 to cause retraction of the first leg of the elbow 2330 into the tubular structure 2320. This action also causes the door hook assemblies 2300 to be drawn up toward the top casing 20 of the doorway. This results in the first leg of the elbow 2330 being moved to an orientation that is at least substantially parallel to the ground surface. In this intermediate position, the bumper 2338 will be below but likely spaced from the underside of the top casing 20. The user than adjusts the device 100 by screwing down the thumb screw 2445 on the threaded second leg of the elbow 2330. This action causes the door hook assembly 2300 to be drawn upward toward the top casing 20 resulting in the bumper 2328 being drawn up and ultimately positioned in contact with and along the underside of the top casing 20 of the doorway. The device 2000 is fully secured within the doorway at this point in time.

As shown, when the device 1000 is mounted in the doorway and the bumpers 1160 sit along the ledge 22 of the top casing 20, the door frame supports 1170 are coupled to the second side supports 1157 by inserting the second side supports 1157 into the slots 1172. The door frame supports 1170 are slide along the second side supports 1157 until the door frame supports 1170 are positioned below an underside (bottom surface) 21 of the top casing 20. The door frame supports 1170 are then rotated (spun) about the second side supports 1157 until they are wedged between the top casing 20 and the frame (i.e., the second side supports 1157) of the device 1000 resulting in further stabilization of the device 1000.

One of the advantages of the present device 2000 is the adjustability of the door hook assemblies 2300. As described herein, the door hook assemblies can be adjusted in two different directions, namely, a first direction that is coaxial to the hollow cross frame member 2320 and a second direction that is coaxial to the second leg of the elbow 2330. The first and second directions are perpendicular to one another. The linear adjustability of the elbow 2330 along the first direction and the adjustability of the door gripper 2335 along the second direction allows the device 100 to provide a universal system that can be used with doorways of different dimensions and thicknesses. With wider doorways, the elbow 2330 is extended a further distance from the end of the hollow cross frame member 2320 to accommodate the wider doorways and properly position the door gripper 2335 above the ledge 22. The subsequent movement of the door gripper 2335 along the second leg in the second direction allows the door gripper 2335 to engage the ledge 22. As mentioned, the subsequent retraction of the elbow 2330 in the first direction and the tightening of the door gripper 2335 causes the leveling and secure attachment of the device 2000 to the doorway.

This adjustability of the door hook assemblies 2300 thus provides the device 2000 with increased versatility and permits it to be used with many different sized doorways. The device 2000 can thus be marketed as a single product with instructions to the user on how to make the necessary adjustments depending upon the precise doorway construction.

Performance of Exercises

As mentioned, the device 2000 can be used to perform a number of different types of exercises, including but not limited to different bodyweight assistance exercises but also different cable weight training movements as well in which the user exercises body parts without any assistance. Exemplary bodyweight assistance exercises include but are not limited to pull-ups, push-ups, and dips. Exemplary weight training cable exercises include are not limited to triceps push downs, and lat pull downs, etc.

To perform an assisted pull-up, the user connects one strap 2800 to the end of the cable 2295 that is closest to the user and is underneath the pull-up bar assembly 2100. As mentioned, a carabiner or the like can be used to attach the strap 2800 to the cable 2295. The user then adjusts the length of the adjustable length main body 2802 such that when the strap 2800 is connected to the end of the cable 2295 and is at rest, the rigid handle 2830 and the outer strap 2832 are generally located at the waist of the user (however, depending upon personal preference and size of user, the location can vary). To begin, the user places one foot onto the rigid handle 2830 and steps down to the floor, thereby raising the counter-weight (weight plate 2500) off the ground. The user grasps the grips 2115 of the first (upper) door bar 2110 and begins to perform an assisted pull-up since the other end of the cable 2295 is connected to the counter-weight, the weight of the user is countered by the weight of the weight plate 2500 and makes it easier for the user to lift his or her own weight as each pull-up is performed. As the user pulls his or her weight toward the first door bar 2110, the weight plate 2500 lowers toward the ground.

An alternative way to perform the assisted pull-up using the strap 2800 is to place the user's knee into the outer strap 2832 instead of placing a foot onto the rigid handle 2830. This action also couples the strap 2800 to the user and the rest of the action is the same or similar. In this embodiment, when the user's knee is in the outer strap 2832 and the other leg is on the ground, the counter-weight (weight plate 2500) must be elevated a distance off the ground. By adjusting the length of the main body 2802 of the strap 2800, this position/state can be achieved. When the user is at rest prior to performing the assisted exercise, the counter-weight must be off the ground to allow the user to raise his or her body to the first door bar 2110 and allow the counter-weight to drop toward/to the ground.

To perform an assisted dip, the dip bar assembly 2600 is attached to the pull-up bar assembly 2100 as described herein. Then a similar process is undertaken in that the user's knee is placed into the outer strap 2832 (it may be possible for the foot to be placed onto the rigid handle 2830 alternatively) and then the user grasps the dip bar and begins to perform a dip.

To perform an assisted push-up, the user connects two straps 28 to a common connector at the cable 2295. The user then places his or her arms through the outer straps 2832 of the two straps 2800 and places the outer straps 2832 on his or her shoulders. The user then drops down into a push-up position and as this action is performed, the counter-weight (weight plate 2500) is raised. When the user places his or her hands on the ground in the push-up position, the counter-weight is elevated a distance off the ground. The user then begins to perform the exercise (push-up).

To perform cable weight training exercises, the user attaches the appropriate exercise equipment (accessory), such as the pull-down bar 2600, to the end of the cable 2295 and then the user performs the exercise, such as a triceps push down or lat pull down. This action by the user results in the raising of the weight plate 2500 off the ground.

While the invention has been described with reference to exemplary embodiments, it will be understood by those skilled in the art that various changes may be made and equivalents may be substituted for elements thereof without departing from the scope of the invention. In addition, many modifications will be appreciated by those skilled in the art to adapt an instrument, situation or material to the teachings of the invention without departing from the essential scope thereof. Therefore, it is intended that the invention not be limited to the embodiment disclosed as the best mode contemplated for carrying out this invention, but that the invention will include all embodiments falling within the scope of the appended claims.

What is claimed is:

1. A device for assisting a user in performing bodyweight exercises as well as being configured for performance of weight training cable exercises comprising:

a frame that is configured to be detachably mounted to a doorframe, the frame including a first door bar and a second door bar that is spaced from the first door bar and is configured for contacting the doorframe on a first side of the doorframe;

a pair of door hook assemblies that are coupled to the frame and are configured to seat against a ledge of the doorframe on a second side of the doorframe for securely yet detachably mounting the frame to the doorframe, wherein each door hook assembly rotates relative to the frame between a folded position and an extended position;

a pulley carrier assembly that is detachably coupled to both the first door bar and the second door bar and includes an elongated carrier that carries a first pulley and a spaced second pulley, the second pulley positioned on the second side of the doorway;

a cable passing along the first pulley and the second pulley, the cable having a first end and an opposing second end; and a counter-weight coupled to the first end of the cable.

2. The device of claim 1, wherein the first door bar and the second door bar are disposed parallel to one another with a pair of cross members extending between and connecting the first door bar to the second door bar, wherein the door hook assemblies are rotatably coupled to the cross members.

3. The device of claim 2, wherein each door hook assembly includes: a first tube that receives one cross member; a second tube that extends outwardly from the first tube; an elbow part that has a first leg that is received within the second tube and a second leg along which a door gripper travels, the door gripper being configured to seat against the ledge.

4. The device of claim 3, wherein each cross member is formed perpendicular to the first door bar and the second door bar.

5. The device of claim 3, further including a first thumb screw disposed along the second tube for controlling a length of the first leg that is exposed beyond the second tube and a second thumb screw disposed along the second leg for controlling movement of the door gripper along the second leg.

6. The device of claim 5, wherein the second thumb screw is defined between a tube portion of the door gripper that is disposed about the second leg and a door finger that has a tube portion that is disposed about the second leg and a finger that is disposed within a hollow interior of a block portion of the door gripper configured for seating against the ledge, wherein movement of the second thumb screw upward along the second leg urges the door gripper upward and movement of the second thumb screw downward along the second leg urges the door gripper downward due to the door finger being coupled to the door gripper.

7. The device of claim 3, wherein the second tube intersects the first tube at an angle other than 90 degrees.

8. The device of claim 3, further including a bumper that is fixedly attached to and extends upwardly from the second tube.

9. The device of claim 1, wherein the pulley carrier assembly includes a support bar hook that includes a through hole through which the elongated carrier extends with the first pulley being located on one side of the support bar hook and the second pulley being located on an opposite side of the support bar hook.

10. The device of claim 9, wherein the support bar hook includes a first slot formed in a first face of the support bar and a second slot formed in an opposing second face of the support bar, the first slot having a hook shape and receives the first door bar, while the second slot receives the second door bar.

11. The device of claim 10, wherein the hook shape is a dog leg shape and the second slot has a semi-circular shape.

12. The device of claim 1, wherein the counter-weight comprises a weight plate that includes a main center pin and at least one secondary pin that is detachably coupled to the weight plate, the first end of the cable being detachably coupled to the main center pin.

13. An exercise device for mounting to a doorframe comprising:

a frame that is configured to be detachably mounted to the doorframe, the frame includes a first door bar and a second door bar that is spaced from the first door bar and is configured for contacting the doorframe on a first side thereof;

a pulley carrier assembly that is detachably coupled to both the first door bar and the second door bar and includes a support bar hook that includes a first slot formed in a first face of the support bar and a second slot formed in an opposing second face of the support bar, the first slot having a hook shape and receives the first door bar, while the second slot receives the second door bar, the pulley carrier assembly further including an elongated carrier that carries a first pulley and a spaced second pulley, the second pulley for positioning on a second side of the doorframe; and a cable passing along the first pulley and the second pulley;

wherein the support bar hook includes a through hole that is open along the first face and the second face, the elongated carrier passing through the through hole such that the first pulley is located along the second face, while the second pulley is spaced from the first face.

14. The device of claim 13, wherein the through hole is located closer to a lower end of the support bar than an upper end thereof and the elongated carrier intersects the support bar at an angle other than 90 degrees.

15. The device of claim 13, wherein the elongated carrier has a U-shape defined by opposing side walls that are spaced apart from one another to define a hollow interior space in which the first pulley and the second pulley are located along with the cable.

16. The device of claim 13, wherein each of the first slot and the second slot have a rounded end wall.

17. An exercise device for mounting to a doorframe comprising:

a frame that is configured to be detachably mounted to the doorframe, the frame includes a first door bar and a second door bar that is spaced from the first door bar and is configured for contacting the doorframe on a first side of the doorframe; and a pair of door hook assemblies that are coupled to the frame and move between a collapsed position and an extended position, each door hook assembly having a first portion that is configured to seat against a ledge of the doorframe on a second side of the doorframe for securely yet detachably mounting the frame to the doorframe, the door hook assembly being adjustable in a first direction and in a second direction that is perpendicular to the first direction;

wherein each door hook assembly includes: a first tube that receives one cross member; a second tube that extends outwardly from the first tube; an elbow part that has a first leg that is received within the second tube and a second leg along which a door gripper travels, the door gripper being configured to seat against the ledge.

18. The device of claim 17, wherein the first direction is a direction that extends toward and away from the second door bar and wherein the second direction is a direction that extends toward and away from the ledge.

19. The device of claim 17, wherein each cross member is formed perpendicular to the first door bar and the second door bar.

20. The device of claim 17, further including a first thumb screw disposed along the second tube for controlling a length of the first leg that is exposed beyond the second tube and a second thumb screw disposed along the second leg for controlling movement of the door gripper along the second leg.

21. The device of claim 20, wherein the second thumb screw is defined between a tube portion of the door gripper that is disposed about the second leg and a door finger that has a tube portion that is disposed about the second leg and a finger that is disposed within a hollow interior of a block portion of the door gripper configured for seating against the ledge, wherein movement of the second thumb screw upward along the second leg urges the door gripper upward and movement of the second thumb screw downward along the second leg urges the door gripper downward due to the door finger being coupled to the door gripper.

22. The device of claim 17, wherein the second tube intersects the first tube at an angle other than 90 degrees.

23. The device of claim 17, further including a bumper that is fixedly attached to and extends upwardly from the second tube.

24. The device of claim 17, further including:

a pulley carrier assembly that is detachably coupled to both the first door bar and the second door bar and includes an elongated carrier that carries a first pulley and a spaced second pulley, the second pulley for positioning on the second side of the doorway;

a cable passing along the first pulley and the second pulley and having a first end and an opposing second end; and a counter-weight coupled to the first end of the cable.

25. A device for assisting a user in performing bodyweight exercises as well as being configured for performance of weight training cable exercises comprising:

a frame that is configured to be detachably mounted to a doorframe, the frame including a first door bar and a second door bar that is spaced from the first door bar and is configured for contacting the doorframe on a first side of the doorframe;

a pair of door hook assemblies that are movably coupled to the frame and are configured to seat against a ledge of the doorframe on a second side of the doorframe for securely yet detachably mounting the frame to the doorframe, wherein each door hook assembly is adjustable in a first direction and in a second direction different than the first direction; and a pulley carrier assembly that is detachably coupled to both the first door bar and the second door bar and includes an elongated carrier that carries a first pulley and a spaced second pulley.

26. The device of claim 25, wherein the second direction is perpendicular to the first direction.

27. The device of claim 25, wherein the first direction is a forward/rearward direction and the second direction is an up/down direction.

* * * * *